US005842605A

United States Patent [19]

Lehmkuhl

[11] Patent Number: 5,842,605

[45] Date of Patent: Dec. 1, 1998

[54] RESUABLE DISPENSER FOR PASTE, LOTION AND CREAM-LIKE MATERIALS

[76] Inventor: Robert A. Lehmkuhl, 3027 Stratford Ct., Loveland, Ohio 45140

[21] Appl. No.: 687,160

[22] Filed: Jul. 24, 1996

[51] Int. Cl.[6] ..... B65D 35/28

[52] U.S. Cl. ..... 222/95; 222/256; 222/309; 222/321.3

[58] Field of Search ..... 222/95, 257, 321.8, 222/556, 256, 321.7, 321.3, 309

[56] References Cited

U.S. PATENT DOCUMENTS

| | | | |
|---|---|---|---|
| 2,690,278 | 9/1954 | Bacheller . | |
| 4,269,238 | 5/1981 | Iwamoto . | |
| 4,457,455 | 7/1984 | Meshberg . | |
| 4,629,097 | 12/1986 | Moore . | |
| 4,691,847 | 9/1987 | Ford et al. | 222/259 |
| 4,715,518 | 12/1987 | Moore . | |
| 4,793,522 | 12/1988 | Corsette . | |
| 4,821,926 | 4/1989 | Battegazzore | 222/209 |
| 4,830,228 | 5/1989 | Fillmore . | |
| 4,872,596 | 10/1989 | Corsette . | |
| 4,903,867 | 2/1990 | Mettenbrink . | |
| 4,936,493 | 6/1990 | Foster et al. . | |
| 4,949,875 | 8/1990 | Kuo | 222/256 X |
| 5,176,291 | 1/1993 | Fillmore et al. . | |
| 5,305,921 | 4/1994 | Kock et al. . | |
| 5,306,125 | 4/1994 | Weag . | |

*Primary Examiner*—Gregory L. Huson
*Attorney, Agent, or Firm*—Frost & Jacobs LLP

[57] ABSTRACT

A dispenser for use with a container of lotion or paste-like product to be dispensed. The dispenser comprises a body having an inlet port connectable to the container and a dispensing spout with a closure cap. The dispenser has a plunger assembly manually shiftable between an unactuated position and an actuated position and a piston shiftable by the plunger assembly between an unactuated position and an actuated position. Both the plunger assembly and the piston are biased toward their unactuated position. As the plunger assembly and piston are shifted toward their actuated positions, the spout cap is opened and the piston causes product to be dispensed through the spout. When the plunger assembly is released and it and the piston return to their unactuated positions, a suck back vacuum withdraws product back into said spout, a vacuum created by the piston draws product from the container into the dispenser and the spout is closed by the cap. The dispenser can be used with a collapsible container or a rigid, uncollapsible container vented by a port provided in the dispenser.

55 Claims, 17 Drawing Sheets

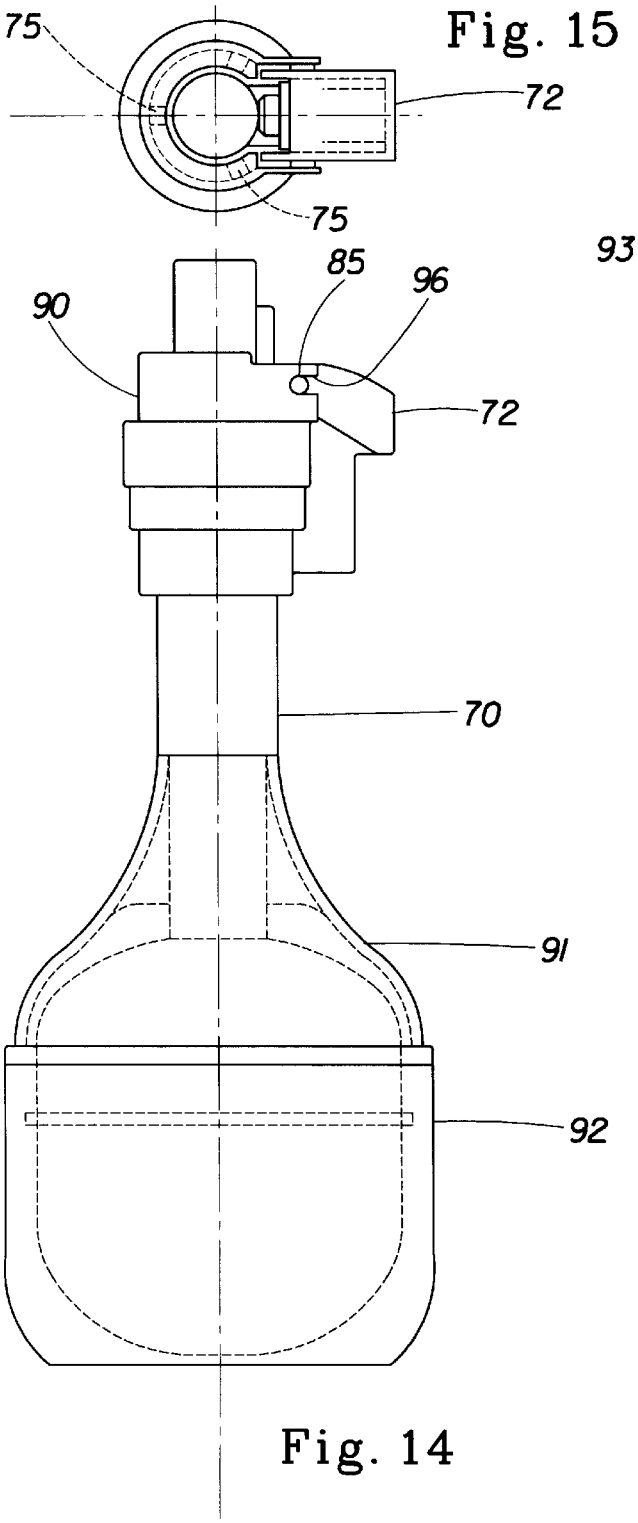
Fig. 15
Fig. 14
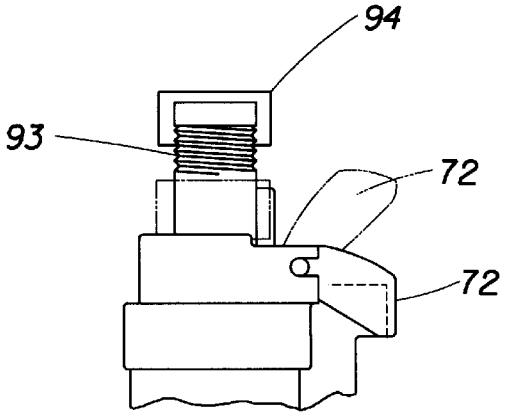
Fig. 16

Fig. 18
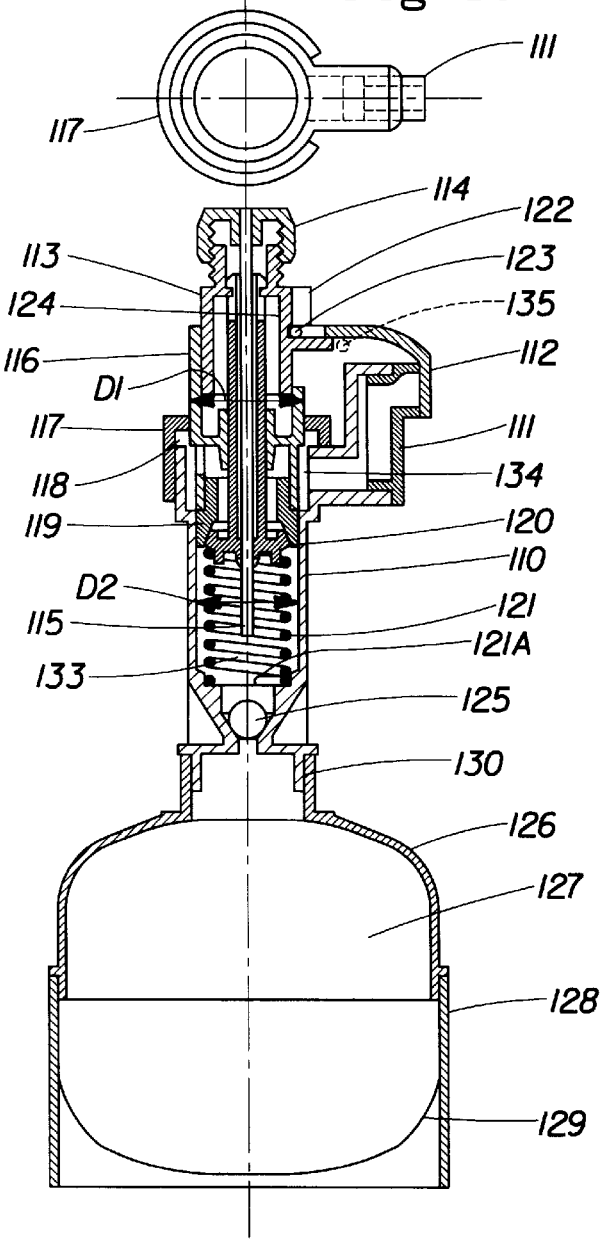
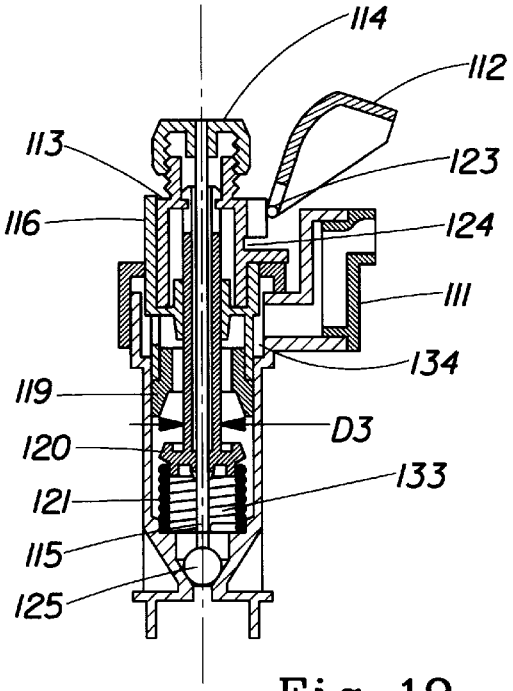
Fig. 19
Fig. 17

Fig. 21
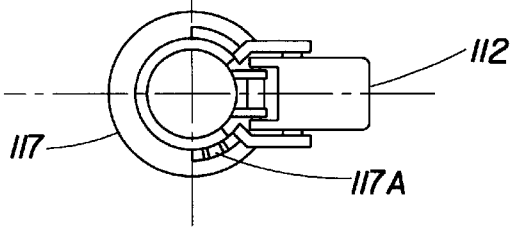
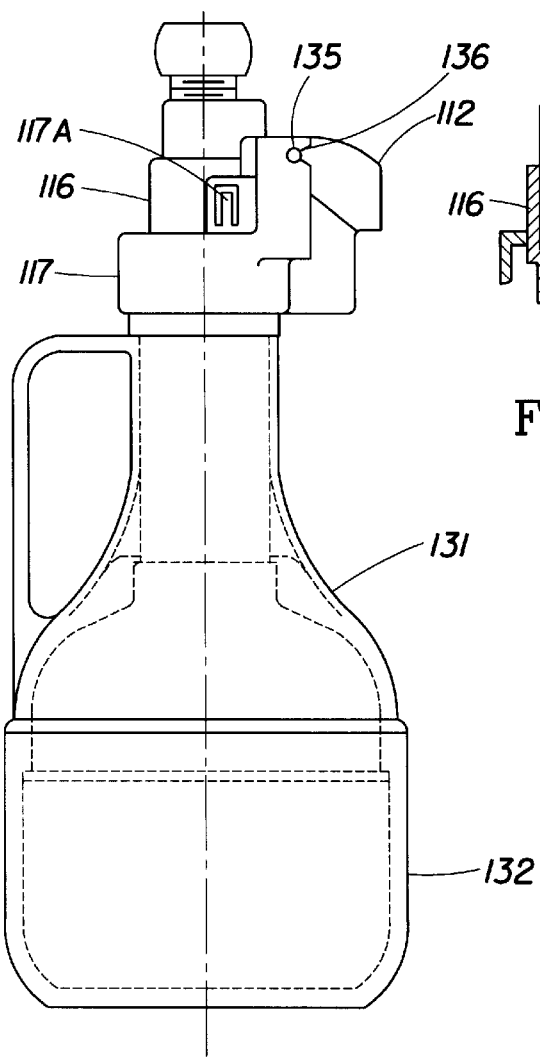
Fig. 20
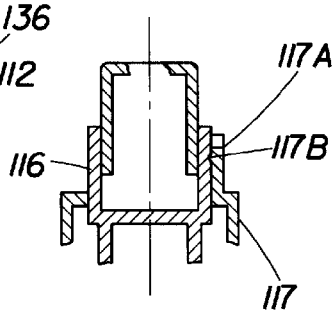
Fig. 22
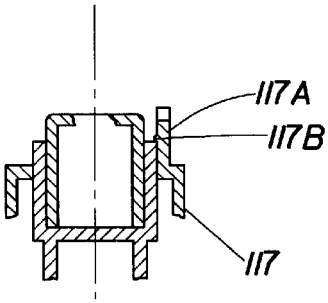
Fig. 23

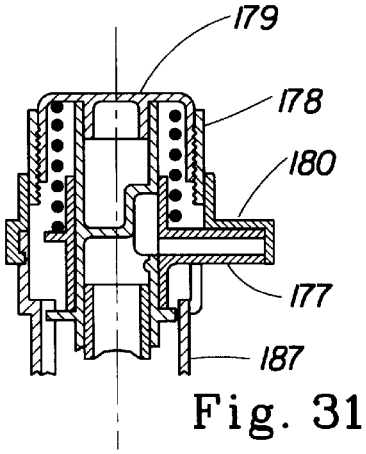
Fig. 31
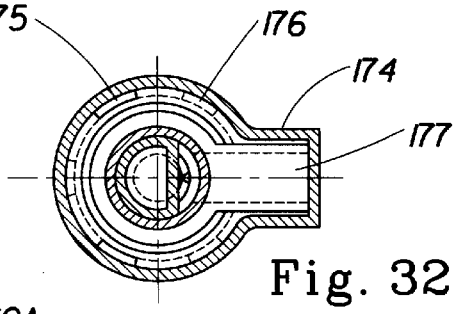
Fig. 32
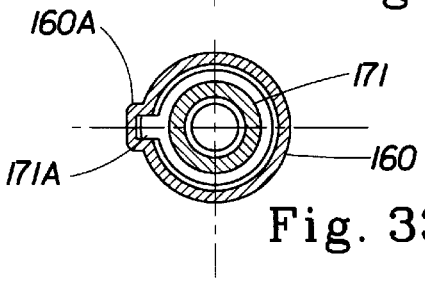
Fig. 33
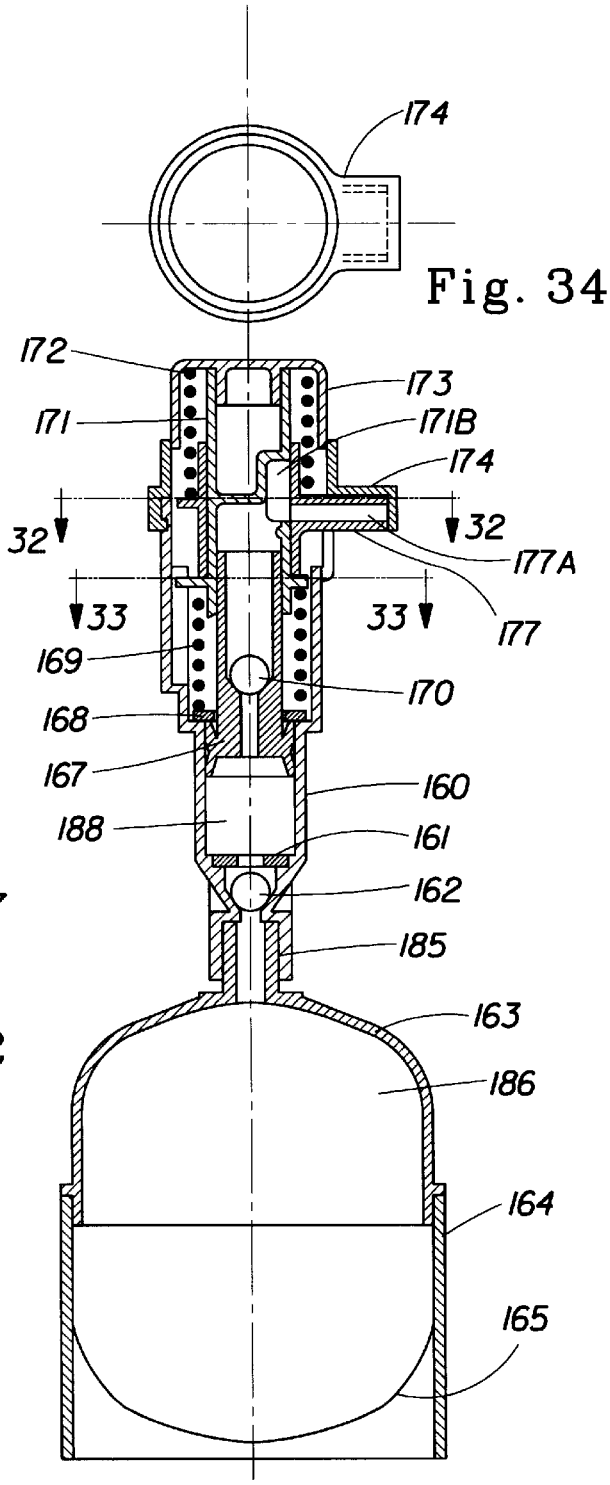
Fig. 34
Fig. 30

RESUABLE DISPENSER FOR PASTE, LOTION AND CREAM-LIKE MATERIALS

TECHNICAL FIELDS

The invention relates to a dispensing system, and more particularly to a reusable, self-opening and closing, decorative dispensing system which may be adjustable to control the amount of product dispensed.

BACKGROUND ART

The primary container for home use toothpaste is the tube. In use, it is necessary to remove the cap and squeeze the tube for paste dispensing. In actual use, each individual squeezes the tube in different locations, deforming the tube unevenly. Quite often the cap is not replaced. The result is a messy looking tube bent into various shapes with hardened toothpaste around the dispensing or cap end of the tube. In some cases the tube is discarded with costly paste still unused inside.

In an attempt to overcome this problem, several toothpaste manufacturers have offered alternative methods of packaging toothpaste. They include dispensers such as a pump type dispenser, a squeezable type dispenser and a stand up type tube dispenser. All require the removal of, or separate manual operation of a cap. If the cap is not replaced after each use, the toothpaste hardens near the opening, and with repeated use builds an unsightly mess on the spout of the dispenser. They all add considerable cost to the product, increase the amount of waste to be discarded or recycled, and they all have a commercial appearance which normally does not enhance the bathroom decor.

None of the above containers offers a means for controlling the amount of product dispensed, which quite often leads to a waste of product dispensed for the intended use. In addition to toothpaste, there are many products, such as creams, lotions, and soaps that would benefit from being precisely dispensed from a reusable self opening and closing highly decorative dispensing system.

Therefore an object of the invention is to provide a dispensing system consisting of a reusable dispenser operated by a simple plunger and a discardable tube or container.

Another object of the invention is to provide for a self-opening and closing dispenser.

Another object of the invention is to provide a reusable dispenser with an adjustment means to control the amount of product to be dispensed.

Another object of the invention is to provide a decorative enclosure for the dispensing system which serves as a pedestal and requires less counter space than a conventional tube and provides a support for one handed operation of the dispense which can be a benefit for the handicapped.

Another object of the invention is to provide a dispenser which has a separate pressure chamber from the container and extracts the product from the container by creating a vacuum.

Another object of the invention is to provide a simple container having an upper shell with an integral anti-collapsible ring and a collapsible bag forming the lower half of the container which is secured to or is integral with the upper shell and acts as a rolling diaphragm as the product is sucked from the container by the vacuum created by the dispenser.

Another object of the invention is to provide a container which can be configured to have the least amount of discardable dispenser material for the amount it contains.

Another object of the invention is to provide a reusable dispenser for use with a rigid tube type container having an unidirectional moving piston which is stationary during the dispensing cycle but moves into the tube when a vacuum is created by the dispenser.

Another object of the invention is to provide for a simple container which can be prefilled by a manufacturer and discarded, or be filled by the consumer from standard containers and which can be reused.

Another object of the invention is to provide for a dispensing system comprising a reusable self opening and closing dispenser and a simple discardable or reusable container which can be used with a broad range of products having the consistency of liquids or of the higher viscosity pastes and creams.

Another object of the invention is to provide a reusable dispenser which can be assembled and disassembled for cleaning without the use of tools.

Another object of the invention is to provide a design and procedure for disassembly without tools which is generally childproof.

Another object of the invention is to provide a means within the reusable dispenser for a positive, controlled product suck-back to reduce any product drippage before the closure occurs.

Another object of the invention is to provide a suck-back action at the spout just as the cap closes, thus causing any residual product to be sucked-back into the spout due to the increased velocity of air passing the spout as the cap closes.

Another object of the invention is to provide a cap which not only seals the spout but provides for a cover or hood over the spout to hide any unsightly residue.

Another object of the invention is to provide a toothbrush locator.

Another object of the invention is to provide a toothbrush holder system so that toothpaste can be dispensed by a person having the use of only one hand.

Another object of the invention is to provide a structure which has a smooth flat surface under a retracted spout for easy cleaning of the spout area.

Another object of the invention is to provide a dispenser with a dispensing spout that is stationary during the dispensing cycle, but which retracts under the hood of a stationary cap after usage to seal the spout.

Another object of the invention is to provide a reusable self-opening and closing dispenser with an adjustment means to control the amount of product dispensed and a means to vent a bottle type container during the dispensing cycle so as not to collapse the bottle and to retain a seal when not being operated.

DISCLOSURE OF THE INVENTION

Since the intent of this invention is to provide a dispensing system to be used with many products by consumers with various interests in decor and dispensing methods, there are four embodiments of the dispenser of the present invention and four types of containers described below. All four dispenser embodiments can be used with three of the four containers. These three containers are of the unvented type which collapse or otherwise reduce in volume. The fourth type of container is a conventional bottle which can operate with two of the four dispensers which can be arranged to vent the bottle during the dispensing cycle.

The Type 1 Dispenser Embodiment

A type 1 dispenser embodiment of the present invention has a moving spout and stationary cap with a hood which covers the spout when the spout is retracted under the hood of the cap. A smooth flat surface is formed by the cap and spout which allows for easy cleaning should any residue form. The spout is integral with or has an attached plunger and is secured to a piston having a hollow head and shaft, a valve seat and compilable sealing rings. An outlet ball valve is fitted so as to have a minimal clearance with the inside diameter of the hollow shaft of the piston and operates against the valve seat of the piston. The spout and piston with the outlet ball valve operate in a cylindrical body. The body is provided with means for removably securing the cap to the top of the body. Several methods of securing the cap may be used, including threads, a breech lock configuration and snap on connection. The present application shows the snap on connection and the breech lock. The body also provides for enclosing a return spring and washer and a seat for an inlet ball valve. The inlet ball valve can be retained by a separate snap-in retainer or by compliant fingers which are integral with the body. The body also has external threads arranged to permit an adjusting nut to control the length of the piston stroke. An alternate nut having a toothbrush locator flange can be furnished if a dental product is being dispensed. In addition, a sliding sleeve type of toothbrush locator or a sliding sleeve type toothbrush holder, each adjusted by a separate nut, can be furnished. The lower portion of the body provides a means for removably securing a container in addition to providing a cosmetic hood or means to attach a cosmetic skirt to cooperate with a removable cosmetic base which covers the container and acts as a pedestal for the dispensing system.

The dispenser as described above has an inline configuration to operate with a lower container. The above dispenser can also be configured to have a body with a lower portion that permits side by side or parallel mounting of the container with respect to the dispenser. This works well where a conventional tube is the container, thus providing a lower overall height. The same parallel mounting can be used with a rolling diaphragm collapsible container which allows for an extremely low profile.

The tube is one of the most common commercial containers for dental and cream products. Since most tubes have a unique cap thread, an adapter specific for each type of tube thread is attached to the tube and then secured to the body of the dispenser being used.

With the rolling diaphragm container, the diameter to length ratio of the container can be optimized to provide for the least amount of container material if the container is to be discarded after use. The conventional tube is usually configured to provide the best configuration for hand squeezing, which requires more material for a given capacity.

The diameter of the container opening at the point it is connected to the dispenser can be much larger than a conventional tube opening. The enlarged opening allows the consumer an easy method of filling or refilling the container. A simple short tubular base for supporting the upper shell during the filling process can be supplied.

A third type of collapsible container consists of a rigid tube with a unidirectional moving piston. The piston is stationary during the dispensing cycle but moves into the tube when a vacuum is created by the dispenser. This tubular container is secured to the dispenser in the same way as the rolling diaphragm container and can act as a dispenser base or be enclosed in a more decorative enclosure. When this type of container is used the inlet check valve in the dispenser body is not required.

In some cases the manufacturers of the product to be dispensed may want to furnish a dispenser and container combination with a proprietary connection so that only their product and container be used with the reusable dispenser.

The Type 2 Dispenser Embodiment

The type 2 dispenser embodiment of the present invention has a stationary spout with a flip type cap. The cap is opened by the initial depression of a plunger which has a low force spring which is compressed during the initial plunger depression. The plunger contacts a piston actuator which is secured to a piston having a hollow shaft and head, a valve seat and compilable sealing rings. An outlet ball valve operates against the piston valve seat and is contained in a chamber formed by the piston actuator. The piston actuator, piston and a piston return spring operate in a dispenser body which has a spout, and a seat for an inlet ball valve. The inlet ball valve is retained by a portion of the piston return spring. The lower portion of the body provides a means for removably securing a container. The outside of the dispenser can be arranged to be coupled to a decorative enclosure which, with a removable lower half provides for a pleasant vase-like appearance and serves as a pedestal for the dispensing system. A retention cap is attached to the upper portion of the dispenser body and provides a guide for the piston actuator and a pivot support for the flip type cap. The lower portion of the dispenser body can also be configured to accommodate a parallel mounting for conventional tubes or the rolling diaphragm collapsible container or the rigid tube type container previously described.

The Type 3 Dispenser Embodiment

The type 3 dispenser has a stationary spout with a flip type cap. The cap is opened by the initial depression of the plunger. This dispenser has a lost motion piston with a detente retention means. A positive disc type valve which is seated in the piston is secured to the plunger by means of a hollow shaft. The plunger slides in a piston actuator which is secured to the lost motion piston. The plunger, actuator and piston operate in a dispenser body which also guides a valve return spring and provides a seat for an inlet ball valve which is retained by a portion of the return spring. A stroke adjusting knob is threaded to the plunger and operates a pin through the center of the valve shaft. The pin contacts the inlet ball valve at the end of the stroke. The dispenser body also has dispensing spout that is covered by the cap. Secured to the upper end of the dispenser body is a pivot bracket which supports the cap and provides for the detent which control the lost motion piston. The lower portion of the body provides a means for removably securing a container. The outside of the body can be arranged to be coupled to a decorative enclosure which, with a removable lower half, provides for a pleasant vase-like appearance and serves as a pedestal for the dispensing system. Since the decorative enclosure can be independent of the dispenser, many different enclosures of different appearance can be envisioned, including dolls or toy soldiers. The lower portion of the dispenser body can also be configured to accommodate a parallel mounting for conventional tubes or the rolling diaphragm collapsible container, and ridged tube container previously described.

The Type 4 Dispenser Embodiment

Type 4 dispenser has a moving spout and stationary cap with a hood which covers the spout. When the spout is retracted under the hood of the cap, a smooth flat surface is formed by the cap and spout which allows for easy cleaning should any residue form. The spout movement is actuated by a plunger but moves only enough to be exposed beneath the hood of the cap. At that point, further movement of the plunger will dispense the product through a now stationary spout. The spout is slidably mounted to a hollow sleeve which is secured to a piston having a hollow shaft and head, a valve seat and compilable sealing rings. An outlet ball valve is fitted so as to have a minimal clearance with the inside diameter of the hollow shaft and operates against the valve seat. The spout, hollow sleeve and piston with the outlet ball valve operate in a cylindrical body. The plunger is secured to the top of the hollow sleeve and captures a low pressure plunger spring between the underside of the plunger and the top of the sliding spout. A higher pressure piston return spring operates between a flange on the hollow sleeve and a spring washer located in the body. The cap is removably secured to the top of the body. Several methods of securing the cap have been considered, including threads, a breechlock configuration and snap on connection. The present application shows the breech lock method which also provides for a generally child proof arrangement. The body also provides for enclosing a return spring and thrust washer and a seat for an inlet ball valve. The ball valve can be retained by a separate snap-in retainer. A modified plunger and cap can also be provided to allow for the addition of an adjusting nut to control the length of the piston stroke. The lower portion of the body provides a means for removably securing a container. The body can be arranged to be coupled to a decorative enclosure which, with a removable lower half, provides for a pleasant vase-like appearance and serves as a pedestal for the dispensing system. Since the decorative enclosure can be independent of the dispenser, many enclosures of different appearance can be envisioned, including dolls or toy soldiers. The lower portion of the dispenser body can also be configured to accommodate a parallel mounting for conventional tubes or the rolling diaphragm collapsible container or the rigid tube type container previously described.

In cases when the product to be dispensed is liquid or low viscosity lotions, a bottle may be the preferred container. In this case, it is necessary to provide a method to vent the bottle during the dispensing operation to prevent atmospheric pressure from collapsing the bottle. It is also necessary to have the bottle sealed when no dispensing occurs. Type 1 and type 4 dispenser embodiments can be modified to operate with a bottle type container by providing a vent hole in the body located just above the piston sealing rings. The vent hole should be placed just beneath the bottle cap inside of the bottle. When not operating the vent hole is sealed from the atmosphere by a separate seal between the piston and body. During the dispensing cycle the piston moves away from the seal and allows atmospheric pressure to be maintained in the bottle. When dispensing low viscosity fluids, the plunger is briskly depressed and released which causes a premeasured amount of product to be ejected or squirted from the spout into the user's hand.

BRIEF DESCRIPTION OF THE DRAWINGS

FIG. 14 is an external elevational view of the type 2 dispenser embodiment configured with a more elaborate vase-like cover and base.

FIG. 15 is a top view of the dispenser of FIG. 14 showing the cap in the closed position.

FIG. 16 is a fragmentary external view of the type 2 dispenser embodiment showing the cap both closed in solid lines and open in broken lines and also showing an adjusting knob threaded to the plunger.

FIG. 17 is a vertical cross-sectional view of the type 3 dispenser embodiment showing the piston and plunger in the fully retracted position and the flip top cap closed. The dispenser shown has a rolling diaphragm container connected to its inlet port. It also has a fully closed collapsible member. A simple cover and base are shown.

FIG. 18 is a top view of the dispenser of FIG. 17 with the cap removed to more clearly show the flow path of product from the staging chamber to the spout.

FIG. 19 is a vertical cross-sectional view of the type 3 dispenser embodiment showing the plunger fully depressed which unseats a disc type valve and displaces a lost motion piston. It also shows the stroke adjusting pin seated against the inlet ball valve. The cap is fully open.

FIG. 20 is an external elevational view of the type 3 dispenser embodiment configured with a vase-like cover and base.

FIG. 21 is a top view of the dispenser of FIG. 20 with the cap closed.

FIG. 22 is a fragmentary cross-sectional view showing the detent system retaining the lost-motion piston actuator in the retracted position.

FIG. 23 is a fragmentary cross-sectional view, similar to FIG. 22, showing the detent system retaining the lost-motion piston actuator in the depressed position.

FIG. 30 is a vertical cross-sectional view of the type 4 dispenser embodiment showing the piston and plunger in the fully retracted position with the spout being sealed by the non-moving cap.

FIG. 31 is a fragmentary vertical cross-sectional view of the type 4 dispenser embodiment showing the plunger arranged to operate with a stroke adjusting nut.

FIG. 32 is a cross-sectional view taken along section line 32—32 of FIG. 30.

FIG. 33 is a cross-sectional view taken along section line 33—33 of FIG. 30.

FIG. 34 is a top view of the dispenser of FIG. 30 showing the dispenser cap.

DETAILED DESCRIPTION OF THE INVENTION

Figure 2:
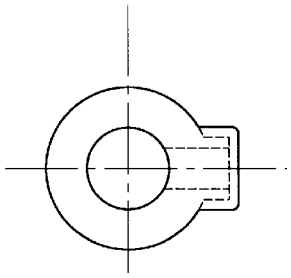
FIG. 2 is a top view of the dispenser cap.
Figure 1:
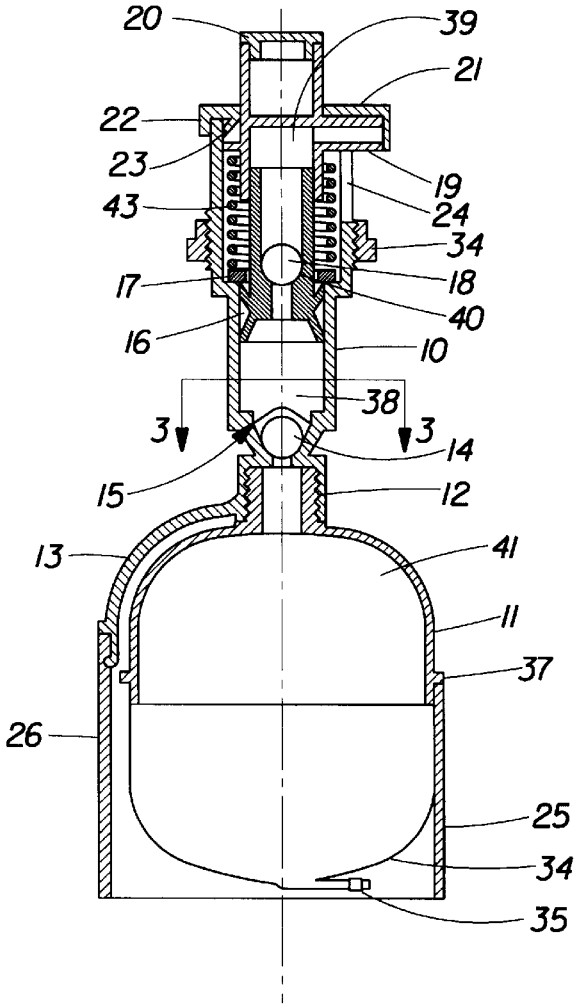
FIG. 1 is a vertical cross-section of the type 1 dispenser embodiment showing the moving spout in the fully retracted position and being sealed by the non-moving cap. The dispenser shown has a rolling diaphragm container connected to its inlet port. The container shown has an opening in the collapsible member which is sealed with an appropriate sealing device. A very simple dispenser, container and container base is shown on the right side of the centerline. A more elaborate dispenser with contoured container hood and detachable base is shown on the left side of the centerline.
Figure 6:
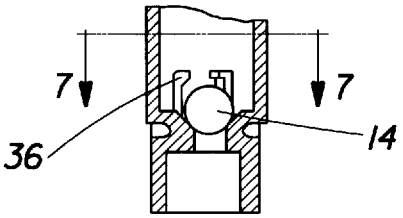
FIG. 6 is a fragmentary vertical cross-section of the type 1 dispenser embodiment having compilable fingers to retain the inlet ball valve.
Figure 9:
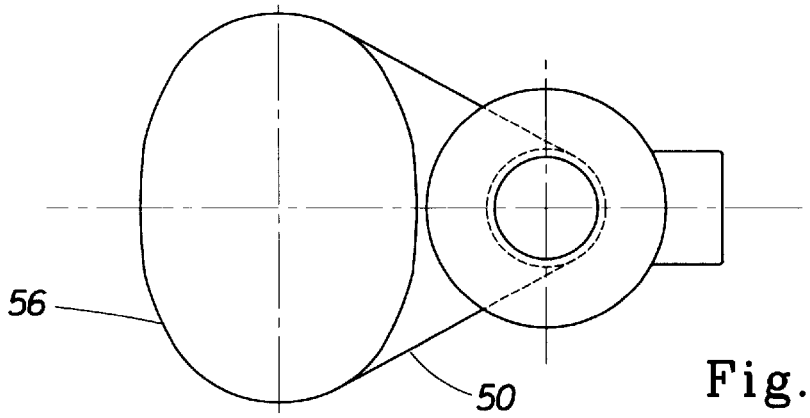
FIG. 9 is a top view of structure of FIG. 8.

The type 1 dispenser embodiment in FIG. 1 comprises a body 10 arranged to have a replaceable container 41 secured to it at its lower end by threaded connection 12. Body 10 can be of the type with an integral decorative hood 13 or a simpler version without the hood shown on the right side of the center line. The upper end of body 10 is open to provide a means of inserting internal components comprising inlet ball valve 14 with ball retainer 15, piston 16, spring washer 17, outlet ball valve 18, return spring 43, and plunger spout 19 having closure 20. The internal components are retained by cap 21 which is secured to body 10 by means of deflectable finger 22 being engaged in an internal groove or notches 23. Cap 21 can also be secured to body 10 by threads or breech lock lugs which are well known in the art. The plunger spout 19 will prevent cap 21 from rotating while plunger spout 19 is in the retracted position. Body 10 also has a slot 24 at its upper end to permit vertical motion of plunger spout 19. Body 10 can be supported by container 41 in cooperation with base 25 or by decorative hood 13 working in cooperation with base 26. Stroke adjusting nut 34 is threadedly connected to body 10. Assembly of inlet ball valve 14 into body 10 can be simplified if body 10 has resilient ball retention fingers 36 as shown in FIG. 6.

Figure 4:
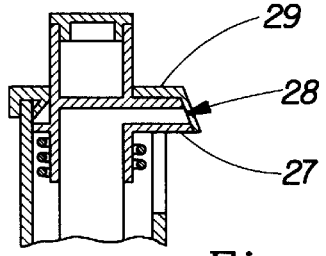
FIG. 4 is a fragmentary vertical cross-section of the upper portion of the type 1 dispenser embodiment having a taper on the end of the spout and a matching surface on the cap.
Figure 3:
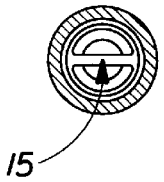
FIG. 3 is a cross-sectional view taken along line 3—3 of FIG. 1.

A variation of the design of the plunger spout and cap interface is shown in FIG. 4. Plunger spout 27 is shown having a tapered end which engages a mating tapered surface 28 of cap 29 when plunger spout 27 is retracted by return spring 43. This tapered surface provides an alternate sealing method when compared to the shear type action of plunger spout 19 and cap 21 and may be advantageous when certain products are being dispensed.

Figure 5:
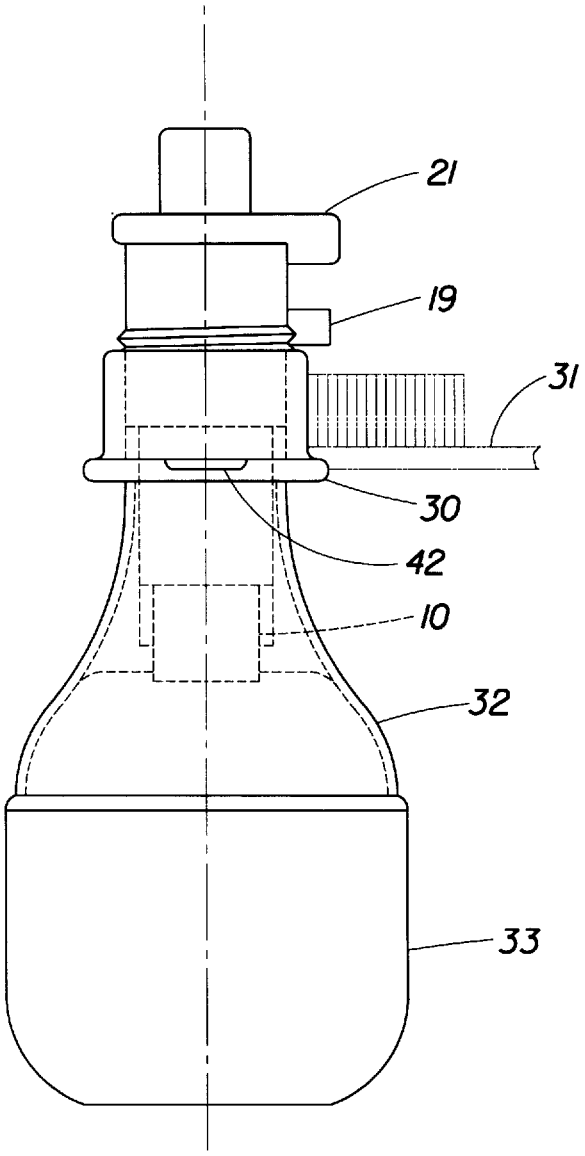
FIG. 5 is an external elevational view of the type 1 dispenser embodiment configured with a more elaborate vase-like cover and base.
Figure 7:
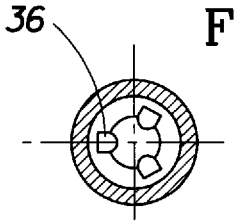
FIG. 7 is a cross-sectional view taken along section line 7—7 of FIG. 6.

The dispenser of FIG. 5 has a highly decorative enclosure consisting of upper skirt 32 and base 33. Skirt 32 is secured to body 10. The lower portion of skirt 32 is open to permit the removal of container 41 (see FIG. 1) for exchange or refilling. Base 33 is removably secured to skirt 32. A variation of the design of stroke adjusting nut is also shown in FIG. 5. Adjusting nut 30 is longer and has a lower flange used to locate toothbrush 31 when the dispenser is used for dental products. Shallow indents 42 on top of the lower flange may aid in locating toothbrush 31 directly under spout 19.

Figure 28:
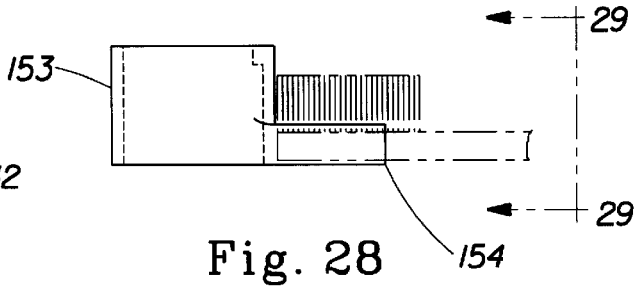
FIG. 28 is an external elevational view of a sliding sleeve brush holder which can be used instead of the brush locator shown in FIG. 24.

A variation of the type 1 dispenser embodiment is shown in FIGS. 24–27. Sliding sleeve 152 has a brush locator 142 and orientation retention key 144 which operates in slot 145 of body 140. Adjusting nut 141 is threadedly engaged on body 140 and adjusts the position of sleeve 152 which determines the travel of spout 151 and the amount of product dispensed. FIG. 28 shows sliding sleeve 153 having brush holder 154. Adjusting nut 141 is used for adjusting position of sliding sleeve 152 for determining the travel of spout 151 and the amount of product dispensed. Body 140 also has groove 148 and slots 149 which operate with 3 lugs 150 on cap 146 to provide a breechlock type of connection for cap 146 to body 140.

Reference is again made to FIG. 1. When operating the type 1 dispenser embodiment, plunger spout 19 is depressed which moves plunger spout 19 downward away from cap 21 and also moves the piston 16 into pressure chamber 38 between the bottom of piston 16 and inlet ball valve 14. It will be noted that the hollow shaft of piston 16 is attached to plunger spout 19. As plunger spout 19 continues to be depressed, the plunger spout 19 will move out from under the hood of cap 21, the product in pressure chamber 38 unseats outlet ball valve 18 in the hollow shaft of the piston 16 and moves ball valve 18 for some distance up the hollow shaft until it reaches enlarged cavity 39 in plunger spout 19. At that point plunger spout 19 is completely exposed and continued depression of plunger spout 19 will cause the product to move past the outlet ball valve 18 and exit through the spout 19. Movement of the outlet ball valved 18 up the hollow shaft of piston 16 provides a precise product dispensing delay until the plunger spout 19 is completely out from under the hood of cap 21. The distance plunger spout 19 can be depressed is determined by the position of adjusting nut 34 on dispenser body 10, therefore controlling the amount of product dispensed.

When plunger spout 19 is released, return spring 43 retracts piston 16 causing a vacuum to start in pressure chamber 38. This will immediately cause outlet ball valve 18 in cavity 39 to retract to valve seat 40 in the hollow shaft of piston 16. Since ball valve 18 is essentially the same diameter as the inside diameter of the hollow shaft of piston 16, it will create a suck-back action at spout 19, causing any product at the end of spout 19 to be sucked-back into spout 19. The amount of suck-back is determined by the length of travel of outlet ball valve 18 in the hole of the hollow shaft of piston 16. This length of travel should be sufficient to prevent any product flow from spout 19 until spout 19 is completely uncovered during the dispensing cycle. After the outlet ball valve 18 in piston 16 is seated, continued retraction of the piston 16 by return spring 43 will cause an increased vacuum in pressure chamber 38 thus causing inlet ball valve 14 in body 10 to unseat and the product in container 41 to enter pressure chamber 38 as atmospheric pressure collapses the lower portion 34 of container 41. If a tube type container is used, the vacuum created by the retraction of piston 16 will cause the product to enter pressure chamber 38 as atmospheric pressure collapses the tube.

Figure 29:
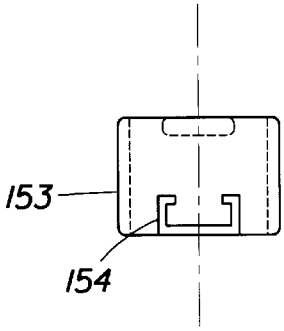
FIG. 29 is an external elevational view of the brush holder shown in FIG. 28 as viewed along line 29—29.
Figure 24:
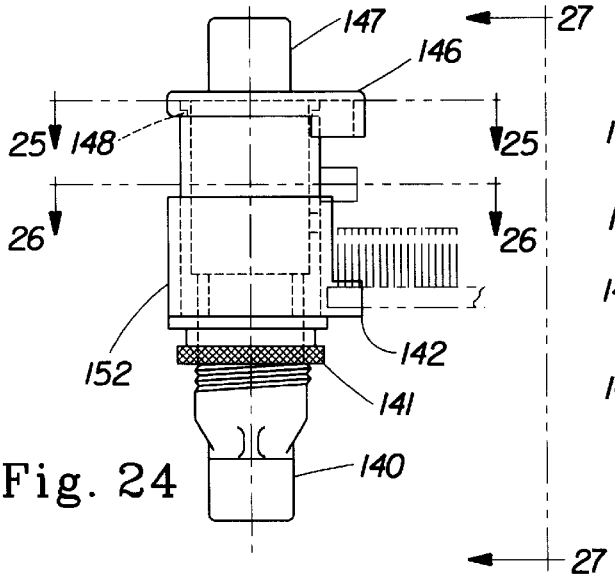
FIG. 24 is an external elevational view of the type 1 dispenser embodiment having a sliding sleeve brush locator positioned by a stroke adjusting nut and also showing the breechlock for cap retention.
Figure 27:
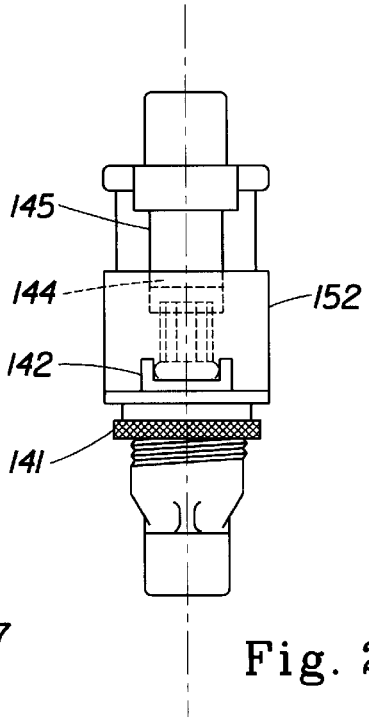
FIG. 27 is an external elevational view of the dispenser shown in FIG. 24 as viewed along line 27—27.
Figure 26:
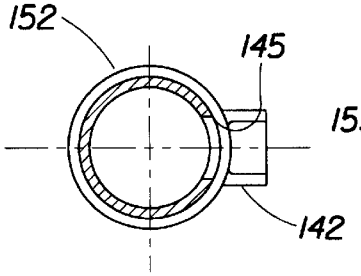
FIG. 26 is a cross-sectional view taken along section line 26—26 of FIG. 24.

The type 1 dispenser embodiment can be arranged for a sliding sleeve 152 and brush locator 142 shown in FIG. 24 or a sliding sleeve 153 and brush holder 154 shown in FIGS. 28 and 29. Brush holder 154 (FIG. 29) is shaped to hold a toothbrush after it is manually inserted in the partially enclosed U-shape extension. The U-shaped extension, with the proper dimensions, will hold many brands of commercially available toothbrushes without any support from the human hand. The dispenser, when operated will open, deposit a predetermined amount of paste on the brush and close. The brush insertion, dispenser operation and brush removal can all be accomplished with one hand.

The type 1 dispenser embodiment (see FIG. 1) can be easily disassembled for cleaning by simply removing cap 21 which allows the internal components to be removed from dispenser body 10. After cleaning and rinsing, the components are easily assembled into dispenser body 10 and cap 21 secured in the manner previously described.

In the type 1 dispenser embodiment shown in FIG. 24, it is necessary to depress plunger 147 an amount that lowers spout 151 enough to permit cap 146 to be rotated so that cap lugs 150 are aligned with slots 149 in body 140, thus permitting cap 146 to be removed for disassembly and cleaning. The combination of requiring depression of plunger 147 and sequential rotation of cap 146 to the proper location provides for a generally childproof disassembly procedure.

The rolling diaphragm type of container 41 (FIG. 1) consists of a rigid or semi-rigid upper shell 11 which is connected to dispenser body 10. The lower portion 34 of container 41 is collapsible and is secured to or is an integral part of upper shell 11. Upper shell 11 is generally semi-spherical in shape and has an anti-collapsing ring 37 about its major diameter. The center of shell 11 has a means for being removably connected to dispenser body 10 or a cap for shipping a full container. Lower collapsible portion 34 has a shape, such that when the dispenser sucks the product from the container, lower portion 34 acts as a rolling diaphragm and will completely collapse into upper shell 11 providing for the complete evacuation of the product from container 41.

Figures 12, 13:
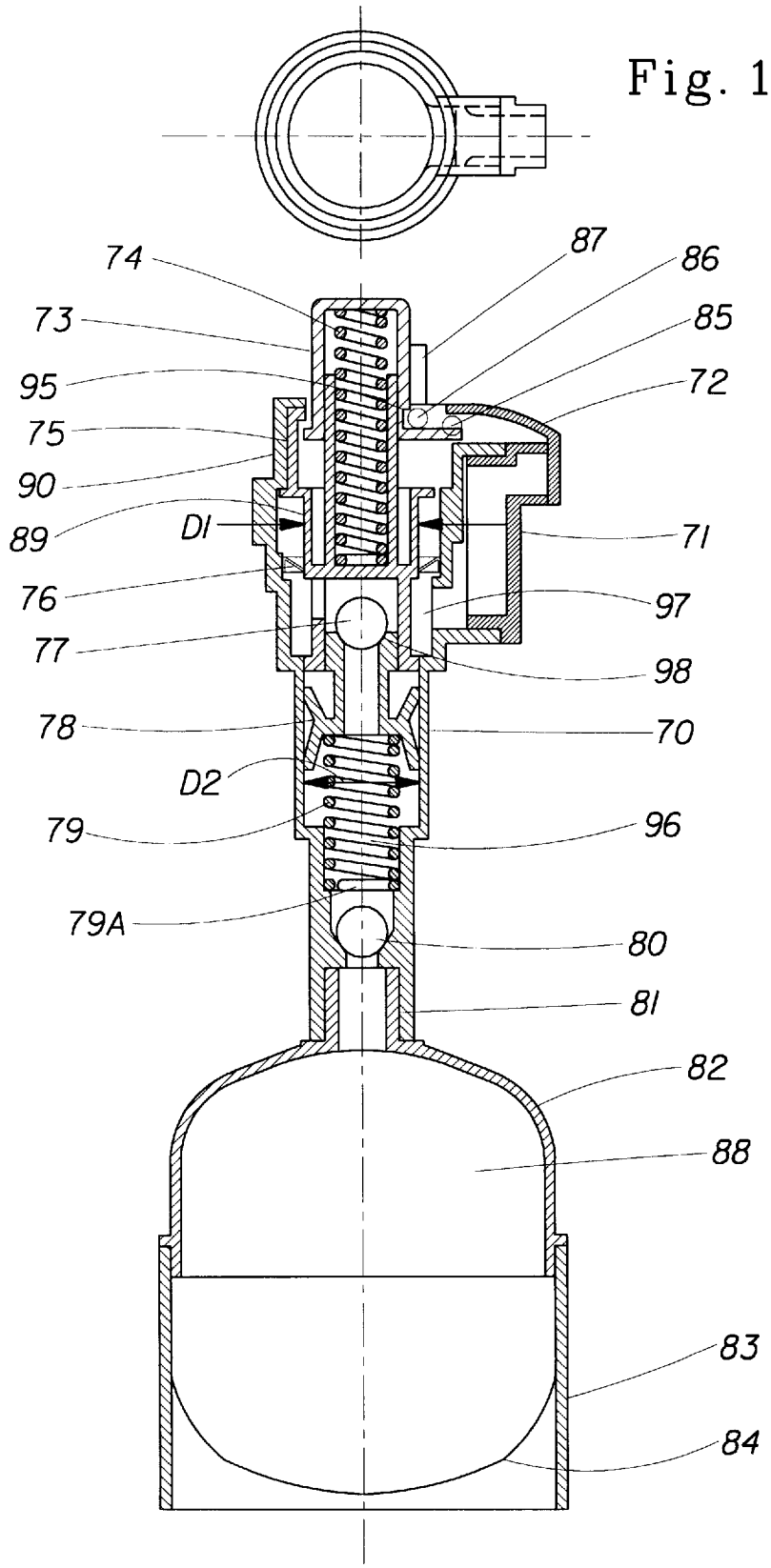
FIG. 12 is a vertical cross-section of the type 2 dispenser embodiment showing the piston and plunger in the fully retracted position and the flip type cap closed. The dispenser shown has a rolling diaphragm container connected to its inlet port. It also has a fully closed collapsible member. A simple cover and base are shown.
FIG. 13 is a top view of the dispenser of FIG. 12 with the cap removed to more clearly show the flow path of product from the staging chamber to the spout.
Figure 25:
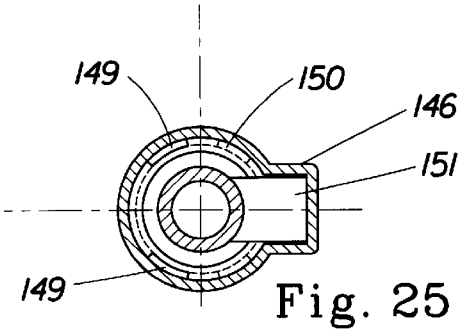
FIG. 25 is a cross-sectional view taken along section line 25—25 of FIG. 24.

The collapsible portion 34 can be configured to have a contoured and closed lower section as shown in FIG. 12 or be open to allow for manufacturing and filling purposes as shown in FIG. 1. If open, then a process to close the lower section to form a leak proof container must be included in the manufacturing cycle. Container 41 is to be made of material that protects all of the qualities of the contents.

Figure 8:
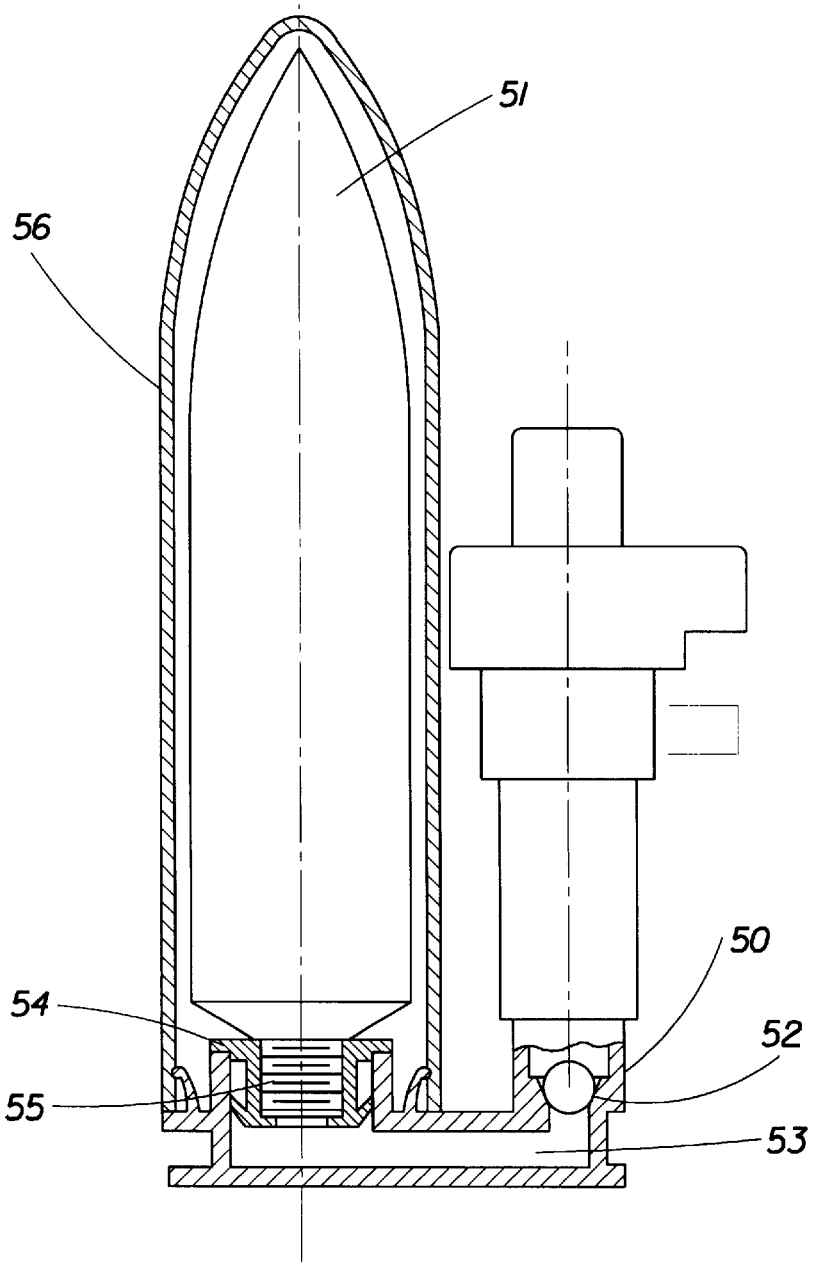
FIG. 8 is an elevational view, partly in cross-section, of the base and related parts of a dispenser arranged for parallel mounting of a tube type container.

Dispenser body 50, shown in FIG. 8, is arranged for the parallel mounting of a tube type container 51. Body 50 can have a variety of configurations to be compatible with the internal components of the type 1, type 2, type 3 and type 4 dispenser embodiments. Body 50 will provide a seat for inlet ball valve 52 which is common to all dispensers. Body 50 also has port 53 which allows the flow of product from tube 51 to inlet ball valve 52. Tube 51 is secured to body 50 by means of adaptor 54 which can be configured to accommodate the variety of threads 55 used with commercial tube type containers. Cover 56 provides a decorative enclosure for tube 51 and is removably secured to body 50.

Figure 11:
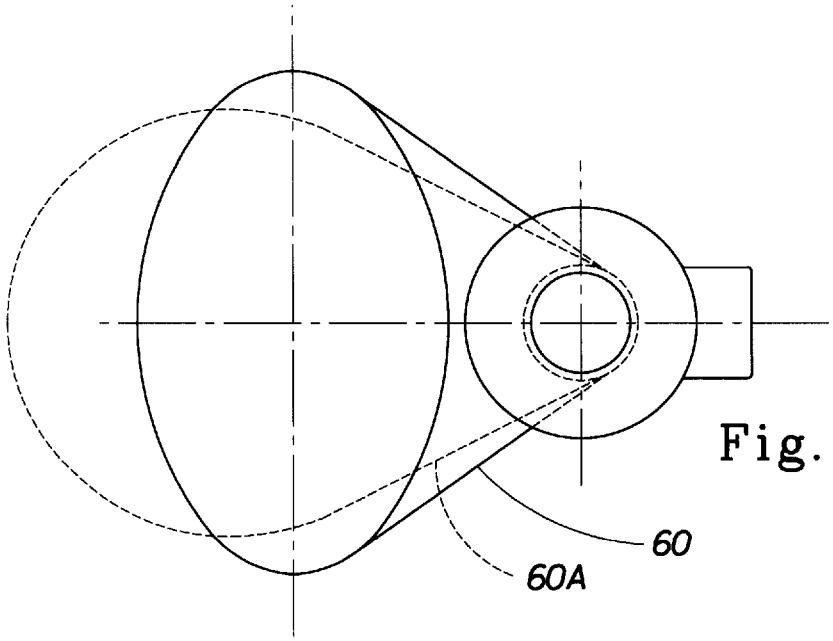
FIG. 11 is a top view of the structure of FIG. 10 showing in solid lines an elliptical section of a rolling diaphragm container and in broken lines a round section rolling diaphragm container.
Figure 10:
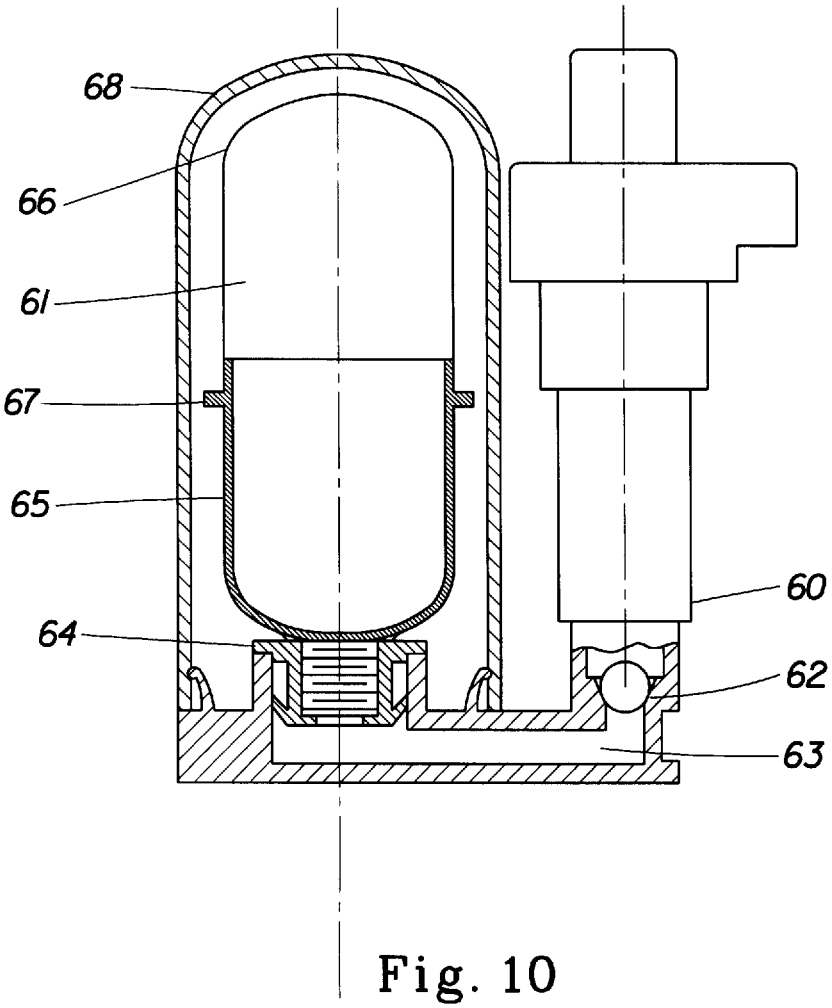
FIG. 10 is an elevational view, partly in vertical cross-section, of the base and related parts of a dispenser arranged for parallel mounting of a rolling diaphragm type container.

Dispenser body 60 shown in FIG. 10 is arranged for the parallel mounting of a rolling diaphragm container 61. Body 60 can have a variety of configurations to be compatible with the internal components of the type 1, type 2 and type 3 dispenser embodiments. Body 60 will provide a seat for inlet ball valve 62 which is common to all dispensers. Body 60 also has port 63 which allows the flow of product from container 61 to inlet ball valve 62. Container 61 is secured to body 60 by means of adapter 64 which is used to allow for a closer mounting of container 61 to dispenser body 60 when container 61 is elliptical in shape as shown on body 60 in FIG. 11. FIG. 11 also shows a dotted outline of a body 60A of a container 61 having a circular shape. Container 61 is comprised of lower shell 65 having anti-collapsing ring 67 and upper collapsible portion 66. When a vacuum is created in dispenser body 60, atmospheric pressure will cause portion 66 to collapse into more rigid shell 65 as product in container 61 is drawn into dispenser body 60.

The shape of container 61 allows for a much lower height as compared to a tube having equal volume. Cover 68 provides for a decorative enclosure for container 61 and is removably secured to body 60.

The type 2 dispenser embodiment shown in FIG. 12 is comprised of body 70 arranged to have a replaceable container 88 secured to it at its lower end by threaded connection 81. The upper end of body 70 is open to provide a means of inserting internal components comprising inlet ball valve 80, piston return spring 74 having an inlet ball valve retaining coil 79A, piston 78, outlet ball valve 77, seal 76, piston actuator 89, plunger return spring 74, plunger 73, retention cap 90 and flip cap 72. Spout 71 may be a separate part or be integral with body 70. The internal components are retained by cap 90 which is secured to body 70 by a press fit or other similar means. Body 70 is supported by upper shell 82 of container 88 in cooperation with base 83 as shown in FIG. 12.

The dispenser of FIG. 14 has a highly decorative enclosure consisting of upper skirt 91 and base 92. Skirt 91 is secured to body 70. The lower portion of skirt 91 is open to permit the removal of container 88 for exchange or refilling. Base 92 is removably secured to skirt 91.

FIG. 16 shows stroke adjusting knob 94 threadedly connected to alternate plunger 93.

Returning to FIG. 12, when plunger 73 is depressed cap 72 will quickly open to fully expose non-moving spout 71 as cap operating slot 95 in plunger 73 moves the operating bar 86 of cap 72 downward causing cap 72 to rotate about the pivot pins 85 of cap 72. Pivot pins 85 are engaged in pivot slots 96 of retention cap 90 (see FIG. 14). After cap 72 is fully opened a slight increase of force on plunger 73 will overcome the force of piston return spring 79 causing the piston actuator 89 and the attached piston to move downwardly as viewed in FIG. 12, the piston 78 moving into pressure chamber 96 between the bottom of the piston 78 and inlet ball valve 80 in body 70. As the piston 78 continues to move, the product in the pressure chamber 96 will unseat outlet ball valve 77 in the hollow shaft of piston 78 and move into staging chamber 97 formed by piston actuator 89 and inside diameter of body 70. From staging chamber 97 the product will be dispensed through spout 71. The distance plunger 73 can be depressed, can be determined by the position of stroke adjusting knob 94, if used, threaded on plunger 93 and therefore controlling the amount of product dispensed (see FIG. 16). Continued movement of plunger 73 to displace piston 78 will not cause cap 72 to open further because operating bar 86 has left cap operating slot 95 and will ride against surface 87 of plunger 73.

When plunger 73 is released, plunger spring 74 will cause plunger 73 to only partially return to its original position because deflectable fingers 75, which are integral with piston actuator 89, limits the return of plunger 73 by acting on the flange of plunger 73. However cap 72 will remain open because cap operating slot 95 of plunger 73 will not have returned to its original position. Furthermore, when plunger 73 is released piston return spring 79 will retract piston 78 causing a vacuum to start to form in pressure chamber 96. This will immediately cause outlet ball valve 77 to seal against piston valve seat 98. Continued retraction of the piston 78 will cause three events to occur. The first is to provide a partial vacuum in staging chamber 97 due to a differential in diameters D1 and D2 of piston actuator 89 operating in dispenser body 70. The amount of differential will determine the amount of product that is sucked back from spout 71 into staging chamber 97. The second event to occur is an increase in vacuum in pressure chamber 96 thus causing inlet ball valve 80 in body 70 to unseat and the product in container 88 to enter the pressure chamber 96 as atmospheric pressure collapses lower portion 84 of container 88. The third event to occur is the final closing of cap 72 as plunger 73 is allowed to return to its original position as piston 78 and piston actuator 89 approach their fully retracted position. As cap 72 closes, the velocity of air passing over the end of spout 71, due to the suck-back action occurring in staging chamber 97, increases as cap 72 shuts off the air supply. This increase in air velocity serves to push any product residue on the end of spout 71 back toward staging chamber 97. The pressure to close cap 72 is determined by piston spring 79. Cap 72 actually stops the retracting motion of the piston 78.

The type 3 dispenser embodiment shown in FIG. 17 is comprised of body 110 arranged to have a replaceable container 127 secured to its lower end by threaded connection 130. The upper end of body 110 is open to provide a means of inserting internal components comprising inlet ball valve 125, return spring 121 having an inlet ball valve retaining coil 121A, disc type valve 120, piston 119, piston actuator 116, plunger 113, and adjusting knob 114 and pin 115. Pivot bracket 117, which incorporates seal 118 is secured to outer surface of body 110 and provides a means of mounting flip cap 112. Pivot bracket 117 also incorporates detent 117A for controlling the motion of lost motion piston 119 and piston actuator 116 (FIG. 22).

Spout 111 can be a separate part or can be integral with body 110. The internal components are retained body in 110 by cap 112, as cap 112 is seated against spout 111 held in place by pivot pins 135 of cap 112 being engaged in pivot slots 136 of pivot bracket 117. Body 110 is supported by upper shell 126 of container 127 in cooperation with base 128 as shown in FIG. 17.

The dispenser in FIG. 20 has a highly decorative enclosure consisting of upper skirt 131 and base 132. Skirt 131 is secured to body 110. The lower portion of skirt 131 is open to permit the removal of container 127 for exchange or refilling. Base 132 is removably secured to skirt 131.

When plunger 113 is initially depressed by means of manual pressure on adjuster knob 114, cap 112 will quickly open to expose non-moving spout 111 as cap operating slot 124 in plunger 113 moves the operating bar 123 of cap 112 downward causing cap 112 to rotate about pivot its pins 135. Pivot pins 135 are engaged in pivot slots 136 of pivot bracket 117 (See FIG. 20). Also when plunger 113 is initially depressed disc type valve 120 will become unseated from piston 119. As disc type valve 120 moves into pressure chamber 133 before piston 119 starts to move, the product in pressure chamber 133 will be displaced into staging chamber 134 as the diameter D3 of the stem of disc type valve 120 moves through staging chamber 134 and into pressure chamber 133. When plunger 113 contacts piston actuator 116 to which piston 119 is attached, a slight increase in force on plunger 113 is required to disengage the piston retention detent 117A from detent notch 117B in piston actuator 116 (see FIG. 22) and cause piston 119 to move into pressure chamber 133 between the bottom of piston 119 and inlet ball valve 125 in body 110. As piston 119 continues to move, the product in pressure chamber 133 will be forced past the now opened valve seat of piston 119 through the hollow shaft of piston 119 and move into staging chamber 134 formed by piston 119, piston actuator 116, seal 118, and the inside diameter of body 110. From staging chamber 134, the product will be dispensed through spout 111. The distance plunger 113 can be depressed is determined by the position of pin 115 which is controlled by the position of adjusting knob 114 threaded to plunger 113. As plunger 113 is being depressed, pin 115 will stop against inlet ball valve 125, therefore controlling the amount of product to be dispensed. It is obvious that pin 115 and knob 114 can be eliminated if a visual feedback is used to control the amount of product dispensed.

When the plunger 113 is released, valve return spring 121 will move disc type valve 120 toward the valve seat of piston 119. The motion will start to create a partial vacuum in pressure chamber 133 as volume of product displaced by diameter D3 of the stem of disc type valve 12 is reduced. This vacuum will cause a precise amount of product in staging chamber 134 and spout 111 to be sucked-back into staging chamber 134. Piston 119 is held in place by detent 117A (see FIG. 23). The movement of valve 120 will also move the plunger toward its initial position. However, cap 112 will remain open because cap operating slot 124 in plunger 113 will not have returned to its original position.

After disc type valve 120 is seated in piston 119, the force of valve return spring 121 will improve piston sealing and overcome piston retention detent 127 causing piston 119 to retract and a vacuum to start to form in pressure chamber 133. The action of disc type valve 120 engaging the valve seat of piston 119 causes sealing ring of piston 119 to increase its pressure on the inside wall of body 110 which aids in forming a vacuum. Continued retraction of piston 119 will cause three events to occur.

The first is to continue a partial vacuum in staging chamber 134 due to the differential in diameters D1 and D2 of the piston actuator 116 and piston 119 operating in the dispenser body 110. The amount of differential will determine the amount of product that is sucked-back from spout 111 into staging chamber 134. The second event to occur is an increase in vacuum in pressure chamber 133, thus causing inlet ball valve 125 in body 110 to unseat and the product in container 127 to enter pressure chamber 133 as atmospheric pressure collapses lower portion 129 of container 127.

The third event to occur is the closing of cap 112. As cap 112 closes, the velocity of air passing over the end of spout 111 due to the suck-back action occurring in staging chamber 134 increases as cap 112 shuts off the air supply. This increased air velocity serves to push any product residue on the end of spout 111 back toward staging chamber 134. The pressure to close cap 112 is determined by valve return spring 121. Cap 112 actually stops the retracting motion of piston 119.

The type 3 dispenser embodiment can easily be disassembled by merely pulling cap 112 horizontally so as to unsnap pivot pins 135 on cap 112 from pivot slots 136 in pivot bracket 117. This allows for easy removal of the internal contents from dispenser body 110. After cleaning and rinsing, the components are easily assembled into the dispenser body. Cap 112 is then resnapped into pivot slots 136 of pivot bracket 117.

Figure 37:
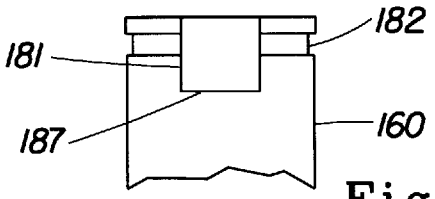
FIG. 37 is a fragmentary external view of the upper portion of dispenser body as viewed along line 37—37 of FIG. 35 with the cap, spout and other components removed.

The type 4 dispenser embodiment shown in FIG. 30 comprises a body 160 arranged to have a replaceable container 186 secured to body 160 at its lower end by threaded connection 185. The upper end of body 160 is open to provide a means of inserting internal components comprising inlet ball valve 162, inlet ball valve retainer 161 and the sub-assembly comprising piston 167, spring washer 168, piston return spring 169, outlet ball valve 170, hollow sleeve 171, spout 177, plunger spring 172 and plunger 173. It will be noted that hollow sleeve 171 is attached to plunger 173 and piston 167 is attached to hollow sleeve 171. Body 160 also has groove 182 (FIG. 37) and slots 175, (FIG. 32) which operate with three lugs 176 of cap 174 to provide a breechlock type of connection for cap 174 to body 160. Spout 177 will prevent cap 174 from rotating while spout 177 is in the retracted position. Body 160 also has slot 181 (FIG. 37) at upper end to permit vertical motion of spout 157. Lower surface 187 of slot 181 stops the vertical motion of spout 177 when plunger 173 is depressed.

FIG. 31 shows stroke adjusting nut 178 threadedly connected to plunger 179. Cap 180 and body 160 have enlarged openings to accommodate the diameter of adjusting nut 178 when stroke adjusting is furnished. Key 171A of the flange of hollow sleeve 171 operates in keyway 160A of body 160 and maintains the orientation of sleeve 171 with respect to spout 177 which is located in slot 181 of body 160. This orientation aligns cavity 171B of hollow sleeve 171 with port 177A of spout 177. This permits the flow of product from the inside of hollow sleeve 171 through port 177A.

Figure 36:
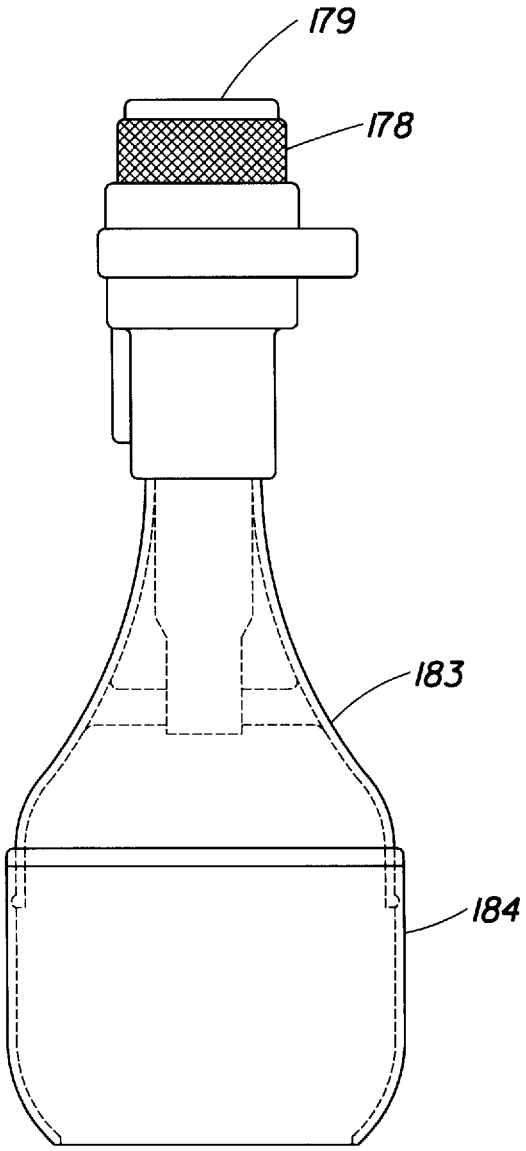
FIG. 36 is an elevational view of the type 4 dispenser embodiment configured with a more elaborate vase-like cover and base.

The dispenser shown in FIG. 36 has a highly decorative enclosure consisting of upper skirt 183 and base 184. Skirt 183 is secured to body 160. The lower portion of skirt 183 is open to permit the removal of container 186 for exchange or refilling. Base 184 is removably secured to skirt 183. Also shown is an external view of adjusting nut 178.

Figure 35:
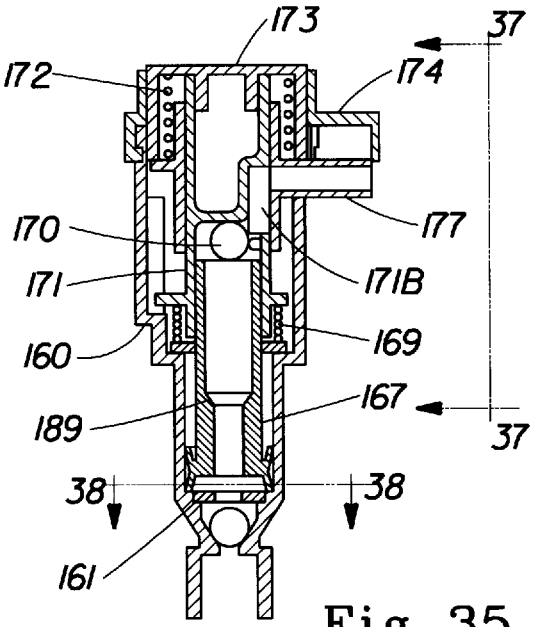
FIG. 35 is an elevational cross-sectional view of the type 4 dispenser embodiment showing the piston and plunger fully depressed and the spout exposed from under the cap and located in the dispensing position by a stroke limiting ledge of the spout slot in the dispenser body.
Figure 38:
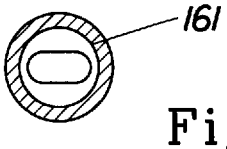
FIG. 38 is a cross-sectional view taken along section line 38—38 of FIG. 30.

FIG. 35 shows the type 4 dispenser embodiment with plunger 173, completely depressed, spout 177 is stopped by surface 187 at a point where it is fully exposed from under cap 174. Piston 167 has traveled the maximum stroke. Piston return spring 169 is compressed and plunger spring 172 is compressed, ball valve 170 is unseated and has moved free of the hole in piston 167. The diameter of ball valve 170 is only slightly smaller than the hole in piston 167.

When operating the type 4 dispenser embodiment, plunger 173 is depressed which moves spout 177 from under hood of cap 174. When spout 177 is fully exposed it will be stopped by surface 187 of slot 181. During this portion of plunger travel piston 167 will have traveled part way into pressure chamber 188, the product in pressure chamber 188 unseats outlet ball valve 170 and causes the ball valve 170 to move free of the hole in piston 167. At this point no product has been dispensed through the dispensing opening 177A in spout 177. As plunger 173 is depressed further, a slight increase in force on plunger 173 is necessary to overcome force of plunger spring 172 which is an indication to the user that product is ready to be dispensed. Further depression of plunger 173 will cause piston 167 to move further into pressure chamber 188 which will displace the product in pressure chamber 188 through hole in piston 167, past unseated ball valve 170, through cavity 171B in hollow sleeve 171 and through dispensing opening 177A in spout 177. The amount of product dispensed can be controlled through visual feedback by controlling the amount plunger 173 is depressed. A more accurate way of controlling the amount of product dispensed is to use stroke adjusting nut 178 and threaded plunger 179 as shown in FIG. 31 in which stroke adjusting nut 179 will be stopped by spout 177 which is seated against surface 187.

When plunger 173 is released, piston return spring 169 retracts piston 167 causing a vacuum to start in pressure chamber 188, this will immediately cause outlet ball valve 170 to retract to valve seat 189 in hollow shaft of piston 167. Since ball valve 170 is essentially the same diameter as the inside diameter of the hollow shaft of piston 167, it will create a suck-back action at spout 177 causing any product at the end of spout 177 to be sucked back into spout 177. The amount of suck-back is determined by the length of travel of ball valve 170 in the bore of the hollow shaft of piston 117 and should be sufficient to prevent any product flow from spout 177 until spout 177 is completely uncovered during the dispensing cycle. After ball valve 170 in piston 167 is seated, continued retraction of the piston 167 by piston spring 169 will cause an increase vacuum in pressure chamber 188 thus causing inlet ball valve 162 in body 160 to unseat and the product in container 186 to enter pressure chamber 188 as atmospheric pressure collapses lower portion 165 of container 186.

The type 4 dispenser embodiment can easily be disassembled for cleaning by depressing plunger 173, enough to bring spout 177 to the position shown in FIG. 35 and before any product is dispensed. This position will allow cap 164 to be rotated so that cap lugs 176 are aligned with slots 175 in body 160 thus permitting cap 174 to be removed for disassembly and cleaning. The combination of requiring depression of plunger 173 and sequential rotation of cap 174 to the proper location provides for a generally child proof disassembly.

Figure 39:
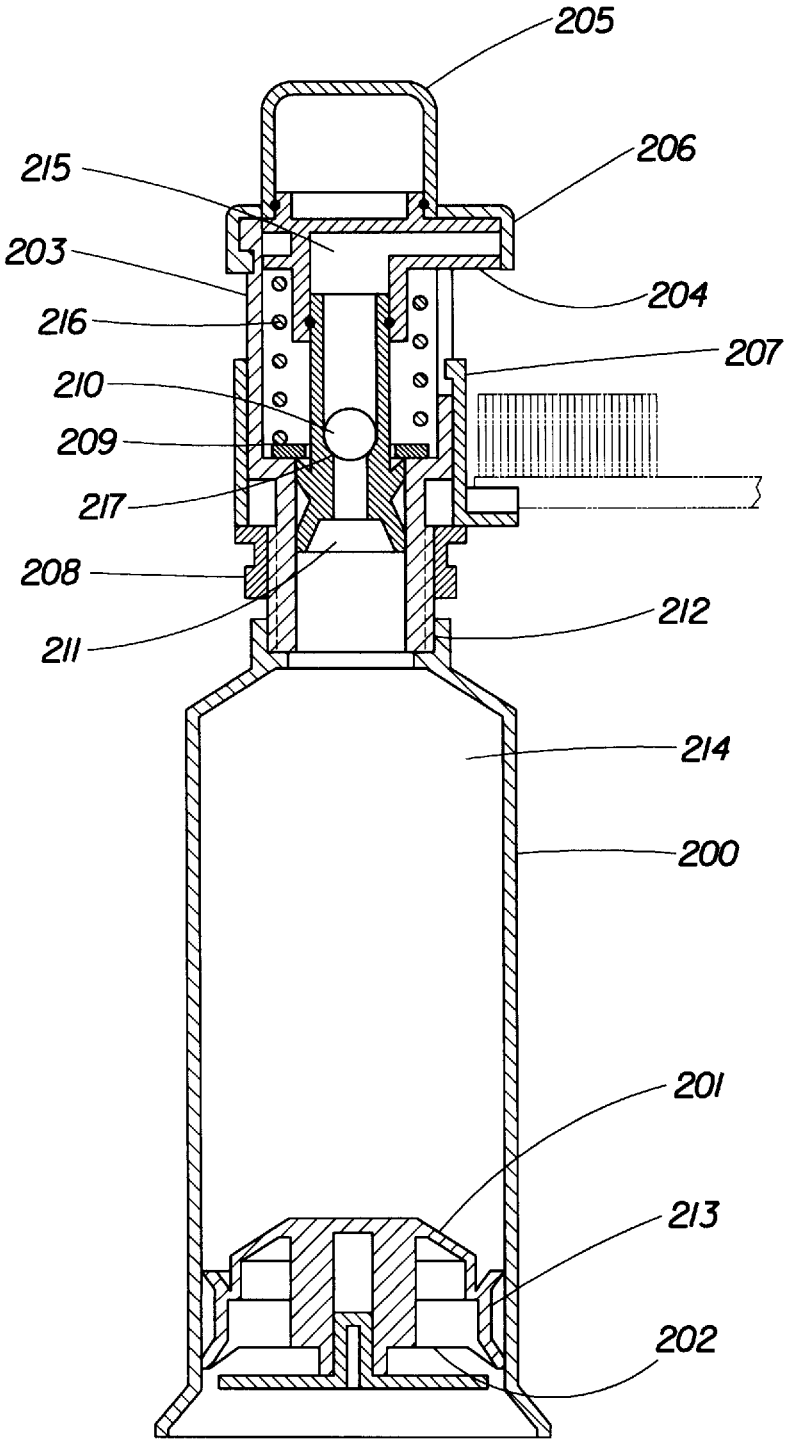
FIG. 39 is a vertical cross-sectional view of a modified version of the type 1 dispenser embodiment with a sliding sleeve brush locator and arranged to operate with a rigid tube type container having unidirectional moving piston.

A rigid tube type container secured to a type 1 dispenser embodiment modified to operate with this type of container, is shown in FIG. 39. Container 214 is comprised of outer shell 200 having unidirectional piston 201 slidably operating in its inside diameter. Piston 201 has sealing rings 213 and spring device 202 attached which allows the piston to move toward the dispenser end of shell 200 but prevents it from moving away from the dispenser. Outer shell 200 is configured at its upper end to be secured to dispenser body 203 by threads 212. The threads 212 can be used with a removable sealing cap for shipping a full container. The type 1 dispenser embodiment shown is arranged to have a sliding sleeve brush locator 207 and a stroke adjusting nut 208. Plunger 205 and spout 204 have been modified to show a different appearance profile. The type 1 dispenser embodiment shown also is devoid of any inlet check valve as shown in applications with the collapsible tube and rolling diaphragm type of collapsible containers. All four of the basic embodiments can be modified to operate with the rigid tube container by eliminating the inlet check valve.

When the plunger 205 of the type 1 dispenser embodiment shown in FIG. 39 is depressed, spout 204 is moved downward away from cap 206 and also moves piston 211 into the pressure chamber established between the bottom of piston 211 and top of unidirectional piston 201 in container 214, uni-directional piston 201 cannot move toward open end of shell 200 because of spring device 202 prevents it. As plunger 205 continues to be depressed, spout 204 will move out from under the hood of cap 206, the product in pressure chamber unseats outlet ball valve 210 in hollow shaft of piston 211 and moves ball valve 210 for some distance up the hollow shaft until it reaches enlarged cavity 215 in spout 204. At that point spout 204 is completely exposed and continued depression of spout 204 will cause the product to move past the ball valve 210 and exit through spout 204. The distance plunger 205 can be depressed is determined by position of adjusting nut 208.

When plunger 205 is released, return spring 216 retracts piston 211 causing a vacuum to start in pressure chamber. This will immediately cause ball valve 210 in cavity 215 to retract to valve seat 217 in the hollow shaft of piston 211. Since ball valve 210 is essentially the same diameter as the inside diameter of the hollow shaft of piston 211, it will create a suck-back action at spout 204, causing any product at the end of spout 204 to be sucked back into spout 204. The amount of suck-back is determined by the length of travel of ball valve 210 in the bore of the hollow shaft of piston 211 and should be sufficient to prevent any product flow from spout 204 until spout 204 is completely uncovered during the dispensing cycle. After ball valve 210 in piston 211 is seated, continued retraction of piston 211 by spring 216 will cause an increase in vacuum in pressure chamber thus causing atmospheric pressure to act on piston 201 in rigid tube container 214 to move toward dispenser as piston 211 become fully retracted. It is obvious that the type 2, 3 and 4 embodiments of dispensers can also be modified to operate with the rigid tube type container.

Figure 40:
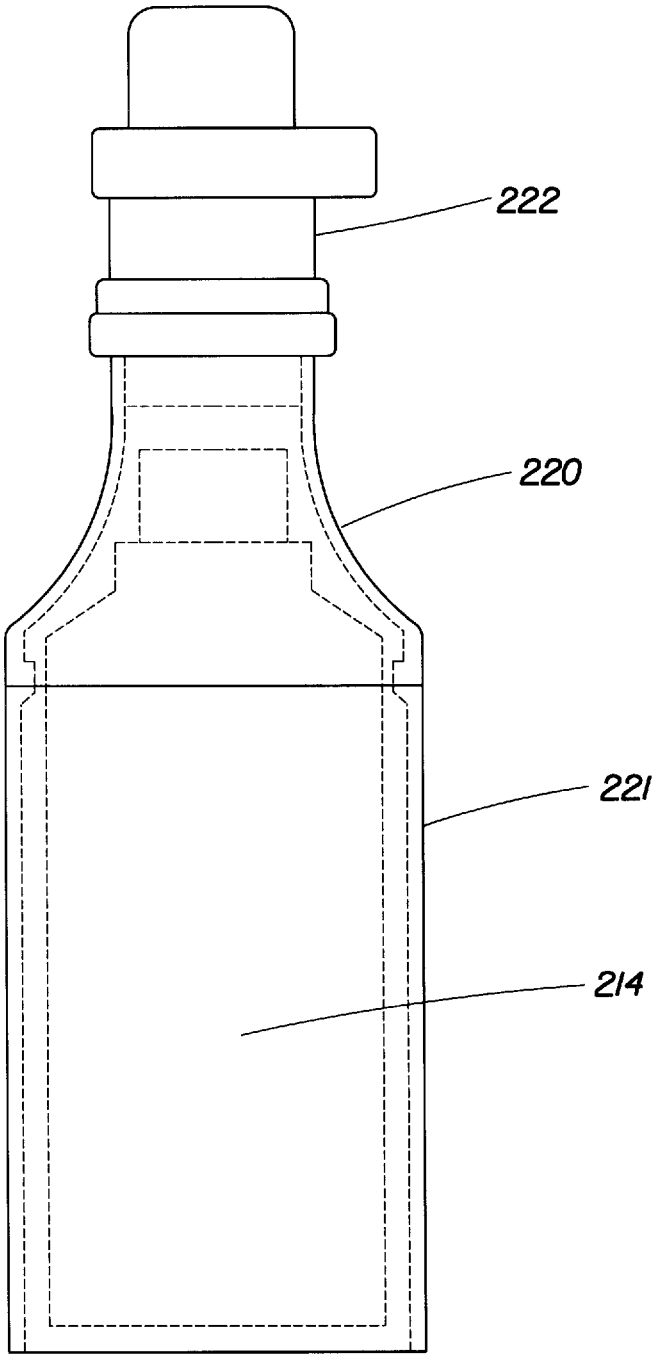
FIG. 40 is an elevational view of the type 1 dispenser embodiment and a rigid tube type container having a more elaborate vase-like cover and base.

FIG. 40 shows type 1 dispenser 222 in combination with rigid tube container 214. For improved appearance an upper cover 220 is secured to dispenser body 203. Base 221 is removably secured to cover 220. Base 221 is removed when container 214 needs to be replaced with a full container.

Figure 41:
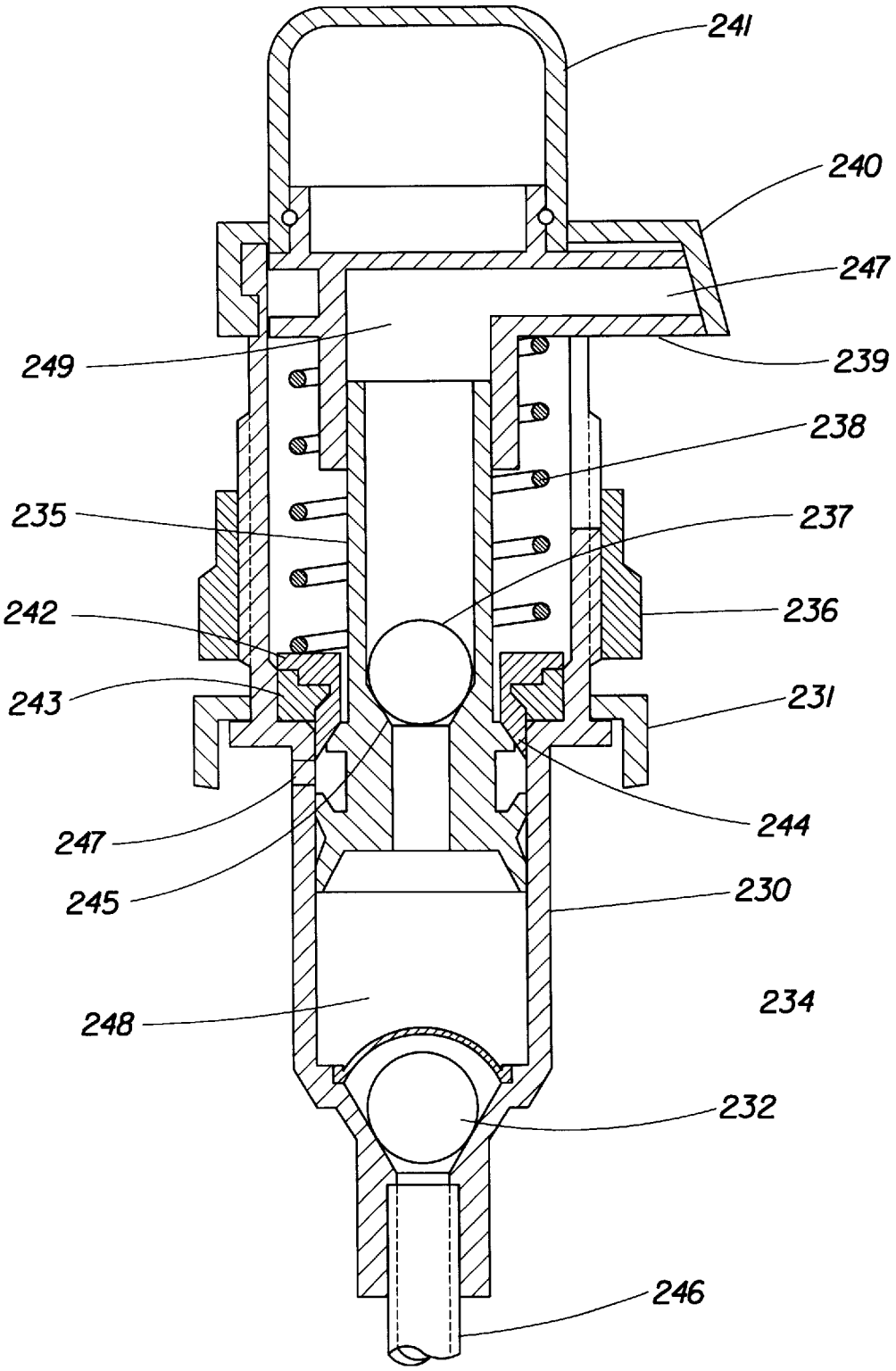
FIG. 41 is an enlarged, fragmentary, vertical cross-sectional view of the type 1 dispenser modified to provide container venting.
Figure 42:
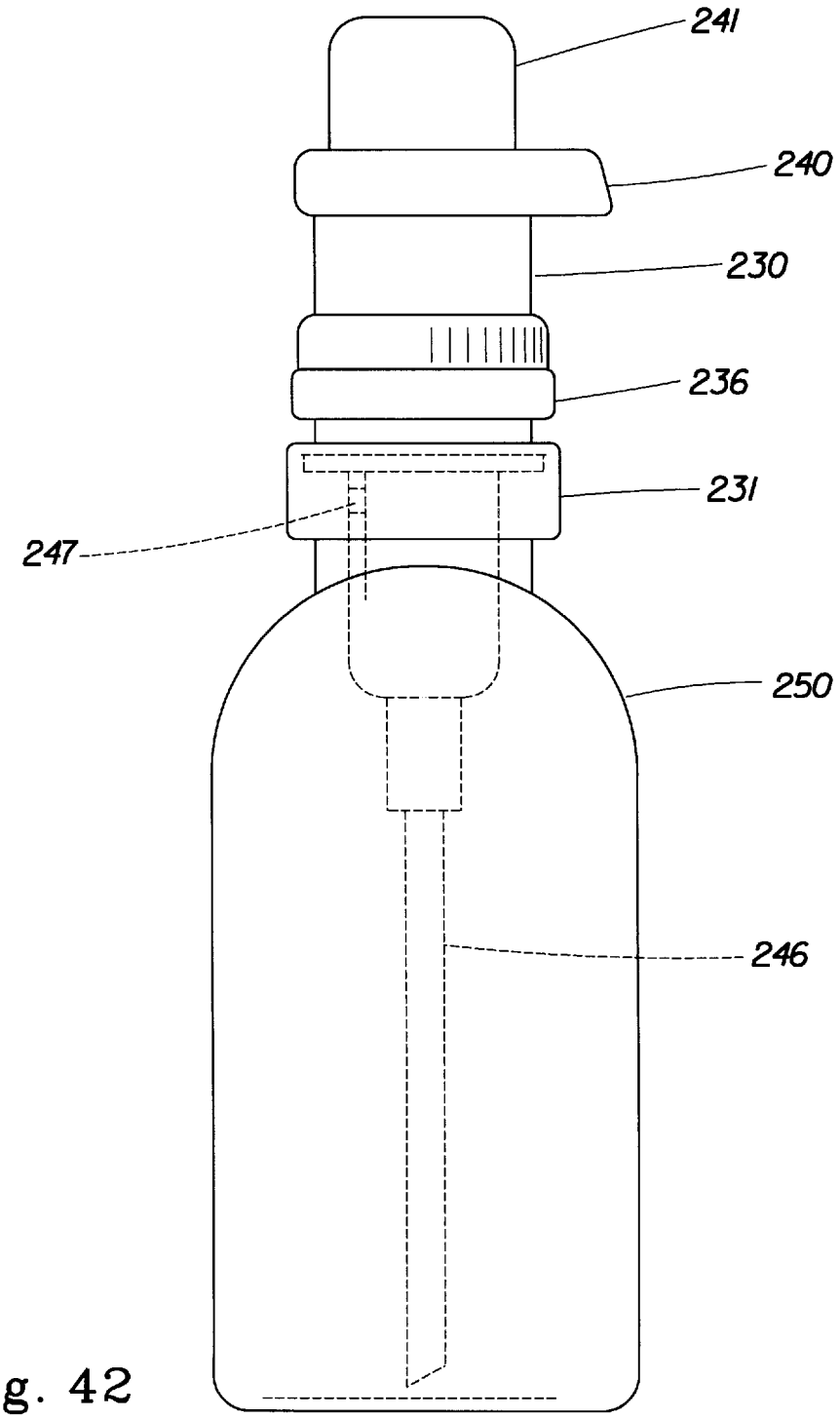
FIG. 42 is an elevational view of the type 1 dispenser embodiment with the venting modifications and secured to a non-collapsing bottle type container.

A type 1 dispenser embodiment having a venting arrangement for use with a bottle type container is shown in FIG. 41 and is comprised of a body 230 arranged to have a suction tube 246 secured to it at its lower end. The upper end of body 230 is open to provide a means of inserting internal components comprising inlet ball valve 232 with valve retainer 234, piston 235, rigid seal support 243, compliant seal 242, outlet ball valve 237, return spring 238, spout 239 secured to plunger 241. The internal components are retained in body 230 by cap 240 which is secured to body 230 by means previously described. Body 230 is generally inserted into bottle type container 250 (FIG. 42) and retained by a threaded bottle cap 231. Stroke adjusting nut 236 is threadedly connected to body 230. If dispenser is shipped with a full bottle, adjusting nut 236 can be moved upward until it forces spout 239 against tapered surface of cap 240 thus causing a leak proof seal to occur at surface 247 and also to occur between compliant seal 242 and piston 235 at surface 244. Therefore the product cannot leak past surface 244 or from spout 239 in the event accidental pressure is exerted on plunger 241 or exterior of bottle 250 during shipping and handling. A similar safety precaution can be made by inserting a discardable U-shaped clip (not shown) over cap 240 and under spout 239 which in effect locks spout 239 to cap 240 in the position shown in FIG. 41. The body 230 is also provided with a vent hole 247, the purpose of which will be apparent hereinafter. It is obvious a similar venting arrangement can also be added to the type 4 dispenser embodiment.

When operating the type 1 vented dispenser embodiment shown in FIG. 41, plunger 241 is depressed which moves spout 239 downward away from cap 240 and also moves piston 235 into pressure chamber 248 between the bottom of piston 235 and inlet ball valve 232. At this time angled shoulder 244 on piston 235 moves away from compliant seal 242 which opens vent hole 247 in body 230 to atmospheric pressure outside of bottle type container 250 of FIG. 42. The inside of bottle 250 remains vented to atmosphere throughout the entire dispensing cycle. As plunger 241 continues to be depressed, spout 239 will move out from under the hood of cap 240, the product in pressure chamber 248 unseats outlet ball valve 237 in hollow shaft of piston 235 and moves ball valve 237 for some distance up the hollow shaft until it reaches enlarged cavity 249 in spout 239. At that point spout 239 is completely exposed and continued depression of plunger 241, will cause the product to move past ball valve 237 and exit through spout 239. The distance plunger 241 can be depressed is determined by the position of adjusting nut 236 threaded to dispenser body 230, therefore controlling the amount of product dispensed.

When plunger 241 is released, return spring 238 retracts the attached piston 235 and spout 239 causing a vacuum to start in pressure chamber 248. This will immediately cause outlet ball valve 237 in cavity 249 to retract to valve seat 245 in the hollow shaft of piston 235. Since outlet ball valve 237 is essentially the same diameter as the inside diameter of the hollow shaft of piston 235, it will create a suck-back action at spout 239, causing any product at end of spout 239 to be sucked back into spout 239. The amount of suck-back is determined by the travel of ball valve 237 in the hole of hollow shaft of piston 235 and should be sufficient to prevent any product flow from spout 239 until spout 239 is completely uncovered during the dispensing cycle. After outlet ball valve 237 in piston 235 is seated, continued retracting of piston 235 by spring 238 will cause an increased vacuum in pressure chamber 248 thus causing inlet ball valve 232 in body 230 to unseat and the product in bottle 250 to enter pressure chamber 248 through suction tube 246 as atmospheric pressure acts on surface of product in bottle to force product up suction tube 246. When piston 235 is fully retracted angled shoulder 244 of piston 235 is again seated against compliant seal 242 thereby preventing contents in bottle 250 from accidentally spilling through vent hole, also spout 239 is again sealed against cap 240. Rigid seal support 243 is configured to support or back-up the lip of the compliant seal 242 when piston sub-assembly is removed or replaced into body 230. This design allows easy insertion into body 230 since inside diameter of rigid seal support 243 is matched to inside piston diameter of body 230.

Figure 43:
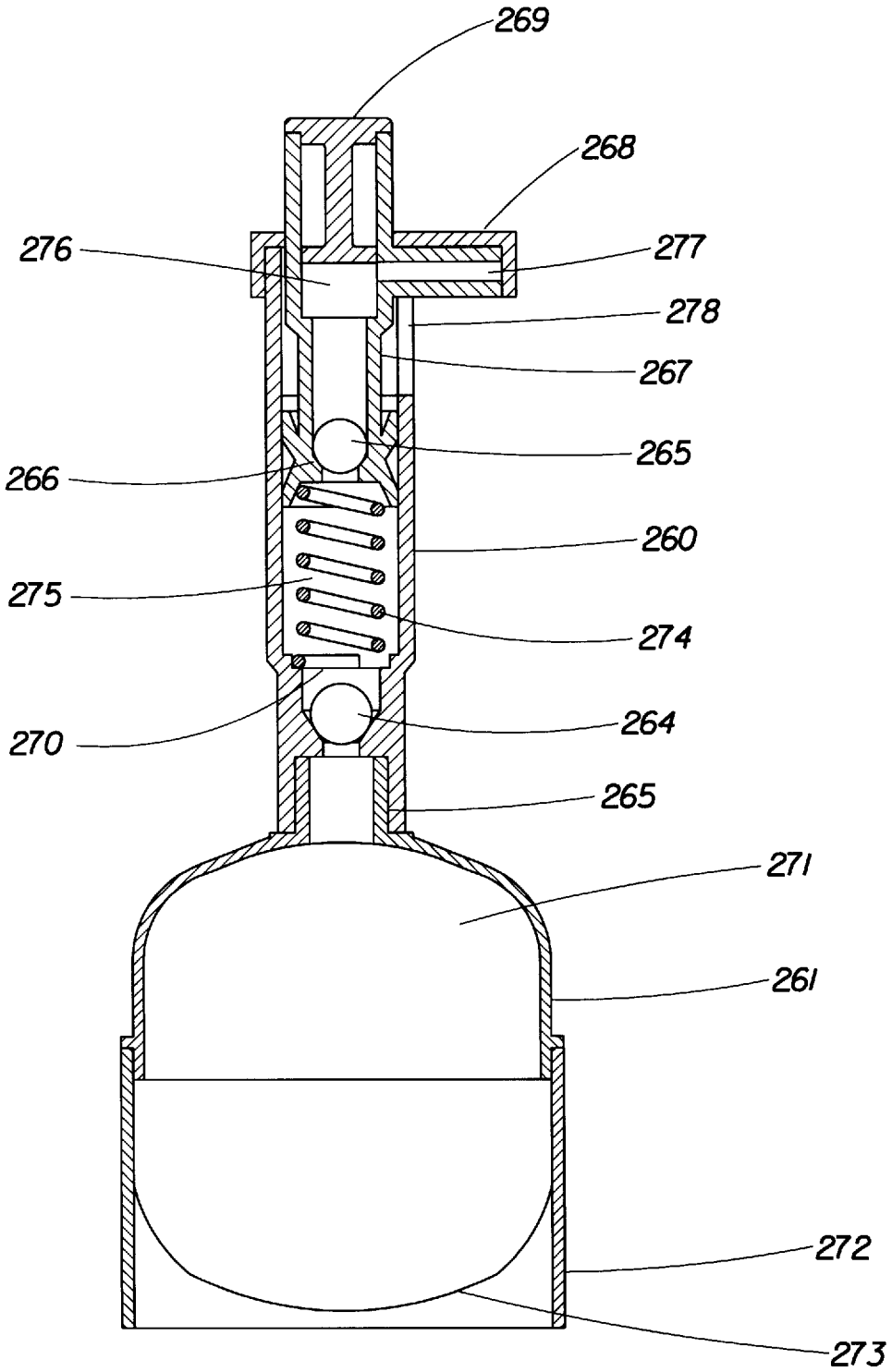
FIG. 43 is a vertical cross-sectional view of a simplified type 1 dispenser embodiment.

To meet market demands for low cost dispensers, a simplified type 1 dispenser embodiment with fewer parts and easier to assemble can be offered (see FIG. 43). The simplified type 1 dispenser embodiment has a moving spout and a stationary cap with a hood that covers the spout when the spout is retracted under the hood of the cap, a smooth flat surface is formed by the cap and spout which allows for easy cleaning should any residue form. The spout is integral with a piston having a hollow shaft, a valve seat and compilable sealing rings. An outlet ball valve is fitted so as to have a minimal clearance with the inside diameter of the hollow shaft and operates against the valve seat. The spout/piston with the ball valve operates in a cylindrical body. A plunger, which also retains the outlet ball valve is inserted and secured in the spout/piston. The body is provided with a means of removably securing the cap to the top of the body as previously described. The body also provides for an enclosing a piston return spring and a seat for an inlet ball valve. The ball valve is retained by a modified coil on the return spring. The lower portion of the body provides a means for removably securing a container in addition to providing a cosmetic hood or means to attach a cosmetic skirt to cooperate with a removable cosmetic base which covers the container and acts as a pedestal for the dispensing system.

The simplified type 1 dispenser shown in FIG. 43 comprises a body 260 arranged to have a replaceable container 271 secured to it at its lower end by threaded connection 262. The upper end of body 260 is open to provide a means of inserting internal components comprising inlet ball valve 264, retained by modified coil 270 of return spring 274, spout/piston 267, outlet ball valve 265, and plunger 269. The internal components are retained by cap 268 which is secured to body 260 by means previously described in type 1 dispenser description. Body 260 has a slot 278 at the upper end to permit vertical motion of spout/piston 267. Body 260 can be supported by container 271 in cooperation with base 272.

When operating the simplified type 1 dispenser embodiment, plunger 269 is depressed which moves spout/piston 267 downward away from cap 268 and also moves the spout/piston 267 into pressure chamber 275 between the bottom of spout/piston 267 and inlet ball valve 264. As plunger 269 continues to be depressed, spout/piston 267 will move out from under the hood of cap 268, the product in pressure chamber 275 unseats ball valve 265 in the hollow shaft of the spout/piston 267 and moves ball valve 265 for some distance up the hollow shaft until it reaches enlarged cavity 276 in spout/piston 267. At that point, the spout/piston 267 is completely exposed and continued depression of plunger 269 will cause the product to move past ball valve 265 and through spout exit 277.

When plunger 269 is released, return spring 274 retracts spout/piston 267 causing a vacuum to start in pressure chamber 275. This will immediately cause ball valve 265 in cavity 276 to retract to valve seat 266 in the hollow shaft of spout/piston 267. Since outlet ball valve 265 is essentially the same diameter as the inside diameter of the hollow shaft of spout/piston 267, it will create a suck back action at spout exit 277 of spout/piston 267, cause any product at the end of exit 277 to be sucked back into exit 277. The amount of suck back is determined by the length of travel of ball valve 265 in the hole of the hollow shaft of spout/piston 267 and should be sufficient to prevent any product flow from exit 277 until spout/piston 267 is completely uncovered during the dispensing cycle. After ball valve 265 in spout/piston is seated, continued retraction of the spout/piston 267 by spring 275 will cause an increased vacuum in pressure chamber 275 thus causing inlet ball valve 264 in body 260 to unseat and the product container 271 to enter pressure chamber 275 as atmospheric pressure collapses lower portion 273 of container 271.

Figure 44:
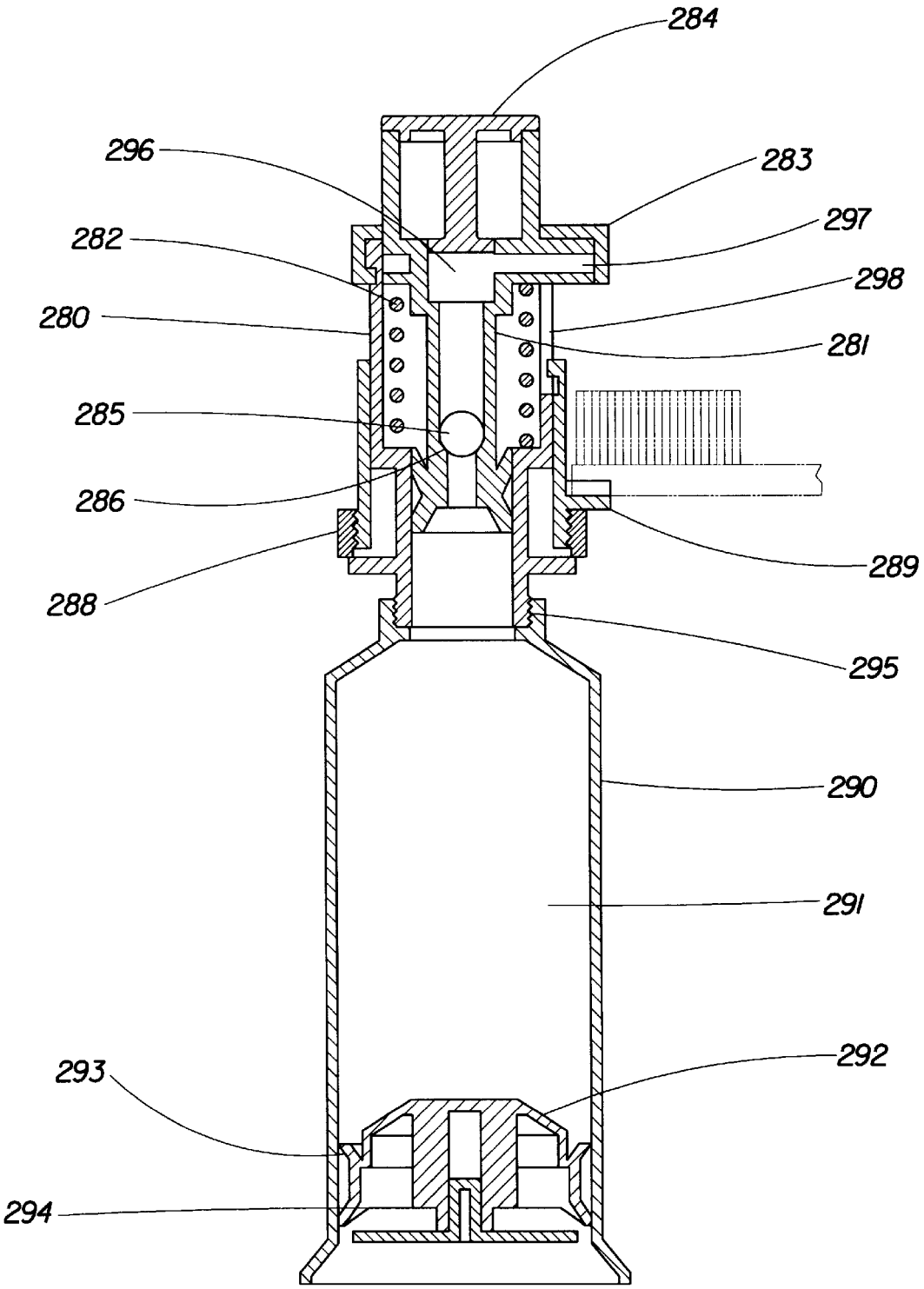
FIG. 44 is a vertical cross-sectional view of a simplified type 1 dispenser embodiment arranged to operate with a rigid tube type container having a unidirectional moving piston.

A rigid tube type container secured to a simplified type 1 dispenser embodiment modified to operate with this type of container is shown in FIG. 44. Container 291 is comprised of outer shell 290 having unidirectional piston 292 slidably operating in its inside diameter. Piston 292 has sealing rings 293 and spring device 294 attached which allows the piston to move toward the dispenser end of shell 290 but prevents it from moving away from the dispenser. Outer shell 290 is configured at its upper end to be secured to dispenser body 280 by threads 295 which can be used with a removable sealing cap for shipping a full container. The simplified type 1 dispenser embodiment shown is arranged to have sliding sleeve brush locator 289 and stroke adjusting nut 288. Plunger 284 and spout/piston 281 have been modified to show a different appearance profile. The simplified type 1 dispenser embodiment shown is also devoid of any inlet check valve as shown in applications with the collapsible tube and rolling diaphragm type of collapsible containers.

When plunger 284 of the simplified type 1 dispenser embodiment shown in FIG. 44 is depressed, spout/piston 281 is moved downward away from cap 283 and also into the pressure chamber 291 established between bottom of spout/piston 281 and top of unidirectional piston 292 in container 291, unidirectional piston 292 cannot move toward open end of shell 290 because spring device 294 prevents it. As plunger 284 continues to be depressed, spout/piston 281 will move out from under the hood of cap 283, the product in pressure chamber unseats outlet ball valve 285 in hollow shaft of spout/piston 281 and moves ball valve 285 for some distance up the hollow shaft until it reaches enlarged cavity 296 in spout/piston 281. At that point spout/piston 281 is completely exposed and continued depression of plunger 284 will cause the product to move past outlet ball valve 285 and through spout exit 297. The distance plunger 284 can be depressed is determined by the position of adjusting nut 288.

When plunger 284 is released, return spring 282 retracts spout/piston 281 causing a vacuum to start in pressure chamber. This will immediately cause outlet ball valve 285 in cavity 296 to retract to valve seat 286 in the hollow shaft of spout/piston 281. Since outlet ball valve 285 is essentially the same diameter as the inside diameter of the hollow shaft of spout/piston 281, it will create a suck back action at spout exit 297, causing any product at the end of exit 297 to be sucked back into spout/piston 281. The amount of suck back is determined by the length of travel of ball valve 285 in the bore of the hollow shaft of spout/piston 281 and should be sufficient to prevent any product flow from spout exit 297 until spout/piston 281 is completely uncovered during the dispensing cycle. After ball valve 285 in spout/piston 281 is seated, continued retraction of spout/piston 281 by spring 282 will cause an increase in vacuum in pressure chamber, thus causing atmospheric pressure acting on piston 292 in rigid tube container 291 to move piston 292 toward dispenser as spout/piston 281 is fully retracted.

As used herein and in the claims, such words as "top", "bottom", "upper", "lower" and the like are used in conjunction with the drawings for purposes of clarity. It will be understood that the dispensers of the present invention could be held in various orientations during use.

Modifications may be made in the invention without departing from the spirit thereof.

What is claimed:

1. A dispenser for use with a separate container of product to be dispensed, said dispenser comprising a body having an inlet port releasably connectable to said container, a dispensing spout, a closing and sealing cap for said spout, an operating plunger shiftable between a normal unactuated position and an actuated position, means biasing said plunger to its unactuated position, means actuable by said plunger to delay product flow as said plunger is shifted toward its actuated position for first opening said spout, means actuable by said plunger as said plunger continues the rest of the way to its actuated position to dispense product from said spout, means initiating a positive controlled amount of suck back of product into said spout upon release and shifting of said plunger from said actuated position to said unactuated position and means for closing said spout with said cap.

2. The dispenser claimed in claim 1 wherein said cap is mounted on said body and said spout is shiftable with said plunger between a position closed and sealed by said cap when said plunger is in its unactuated position and an open position when said plunger is shifted toward its actuated position.

3. The dispenser claimed in claim 1 wherein said container is chosen from the class consisting of a collapsible container, a container and a rolling diaphragm, a rigid container with a uni-directional piston and a vented rigid container.

4. A dispenser for use with a container of product to be dispensed, said dispenser comprising a body having an inlet port at its lower end connectable to an opening in said container and an open upper end, a piston shiftable within said body between a normal retracted position and an actuated depressed position, said piston being spring biased to said normal position, a pressure chamber within said body between said inlet port and said piston, means to prevent the passage of product from said pressure chamber to said container, said piston comprising a head and a stem and an axial bore therethrough, an outlet valve, said piston having a seat for said outlet valve, said outlet valve having an open position and a normal closed position wherein it closes said piston bore, said dispenser having a spout, said piston bore being operatively connected to said spout, a plunger assembly for shifting said piston from said normal retracted position to said depressed actuated position against the action of said spring biasing means, means to open said outlet valve, whereby product from said pressure chamber will pass through said bore of said piston to said spout as said piston moves toward said actuated position, means as said piston returns from said actuated position to said normal position to close said outlet valve, means to create a suck-back vacuum for product in said spout and means to create a vacuum to draw product from said container into said pressure chamber and a closing and sealing cap for said spout.

5. The dispenser claimed in claim 4 wherein said inlet port has a threaded engagement with said container.

6. The dispenser claimed in claim 4 wherein said container is a collapsible container chosen from the class consisting of a collapsible tube, a container with a rolling diaphragm and a rigid container having an open top connectable to said dispenser inlet port and having an open bottom closed by a unidirectional piston, shiftable only toward said container top, said unidirectional piston comprising said means to prevent product flow from said pressure chamber to said container.

7. The dispenser claimed in claim 4 wherein said container is non-collapsible, means in said dispenser for venting said container to atmosphere when product is withdrawn therefrom to said dispenser pressure chamber.

8. The dispenser claimed in claim 4 including a decorative enclosure, said enclosure having an upper half secured to said dispenser body and a lower half removably secured to said upper half, said enclosure surrounding said container, said enclosure being open to atmosphere.

9. The dispenser claimed in claim 4 wherein said retention cap is removably attached to said dispenser body by one of a snap fit, a threaded engagement and a breech lock lug system.

10. The dispenser claimed in claim 4 including a retaining means for releasably retaining said piston, said piston biasing means, said outlet valve and said plunger assembly in said dispenser body whereby said dispenser can be disassembled and reassembled for cleaning purposes.

11. The dispenser claimed in claim 4 wherein said spout is shiftable with said plunger and piston, a cap secured to said dispenser body, said cap comprising a non-moving seal for said shiftable spout when said piston is in its normal position.

12. The dispenser claimed in claim 4 including a fixed spout and a flip cap pivotable between an open position and a closed position closing and sealing said spout, said flip cap being operable by said plunger.

13. The dispenser claimed in claim 4 wherein said means to prevent product flow from said pressure chamber to said container comprises an inlet ball valve near said dispenser inlet port, said container being chosen from the class consisting of a collapsible container, a container and a rolling diaphragm, a rigid container with a unidirectional piston and a vented rigid container.

14. The dispenser claimed in claim 4 wherein said retaining means comprises a cap removably attached to said upper end of said dispenser body and having a portion adapted to receive, close and seal said spout.

15. The dispenser claimed in claim 14 wherein said spout has a lower surface having external dimensions corresponding to the internal dimensions of said cap portion which receives, closes and seals said cap, said cap portion and said spout located therein having a smooth, easily cleaned bottom surface.

16. The dispenser claimed in claim 14 including a discharge end of said spout being angled downwardly and outwardly, said cap portion for receiving, closing and sealing said spout being correspondingly configured whereby to form a substantially lead-proof seal for low viscosity products.

17. The dispenser claimed in claim 4 wherein said dispenser is mounted on a base, said inlet port of said dispenser being connected to a horizontal bore in said base which terminates in a vertical inlet opening the outlet opening of a collapsible container being removably secured to said vertical inlet opening, said container being parallel to and adjacent to said dispenser body.

18. The dispenser claimed in claim 17 wherein said inlet opening of said base is configured to accept removable adapters, said removable adapters having a seal with said base inlet port, whereby said base inlet opening can accommodate a variety of differently threaded container outlet openings.

19. The dispenser claimed in claim 17 including a decorative cover for said collapsible container, said cover being open to atmospheric pressure.

20. The dispenser claimed in claim 4 wherein said means to prevent product flow from said pressure chamber to said container comprises an inlet ball valve near said dispenser inlet port, a detachable collapsible container having an opening connected to said dispenser inlet port, said container comprising a non-collapsing upper shell and a collapsible lower portion, said lower portion being collapsible into said non-collapsing upper shell by atmospheric pressure as product is withdrawn from said container by said dispenser, said non-collapsing upper shell and said collapsible lower portion being of the same size whereby all of said product can be extracted from said container.

21. The dispenser claimed in claim 20 wherein said upper shell of said container has an integral anti-collapsing ring adjacent said lower portion whereby to prevent atmospheric pressure from collapsing said upper shell while allowing said lower portion to collapse into said upper shell as product is withdrawn by said dispenser from said container.

22. The dispenser claimed in claim 4 wherein said outlet valve comprises a ball valve, said piston stem having an upper end through which said axial piston bore extends, said piston seat for said outlet ball valve being located at said upper end of said piston stem, a piston actuator comprising a first cylindrical portion within which said upper end of said piston stem is attached and forming a chamber thereabove, said first cylindrical portion being surmounted by a second cylindrical portion having a closed lower end and an open upper end, a plunger having an open lower end with a surrounding outwardly directed annular flange and a closed upper end being telescopically and slidably mounted on said second cylindrical portion of said piston actuator, a plunger return spring being located within said second portion of said piston actuator and said plunger, a third cylindrical portion of said piston actuator extending upwardly from said first portion of said piston actuator, said third portion surrounding the lower end of said second portion of said piston actuator and terminating in an outwardly directed annular flange supporting deflectable fingers slidably engaging said plunger above said flange thereof making said plunger captive on said second portion of said piston actuator, said body having a first interior cylindrical portion comprising said pressure chamber of a diameter to slidingly receive said piston head and said first portion of said piston actuator, said body above said pressure chamber, having a second interior cylindrical portion of greater diameter than said pressure chamber an annular seal mounted within said body immediately above said second cylindrical portion, said third portion of said piston actuator being slidable within said annular seal, said second cylindrical body portion, said first piston actuator portion and said annular seal defining an annular staging chamber, said chamber in said first portion of said piston actuator being connected to said staging chamber through a port in said first portion of said piston actuator, said dispenser body having a fixed spout, said spout being connected to said staging chamber, said piston actuator chamber and said staging chamber connecting said piston bore to said spout, said means for biasing said piston to said normal position comprising a piston return spring located between said piston head and an annular shoulder formed in said pressure chamber, retaining means comprising a retention cap affixed to said dispenser body and releasably retaining therein said plunger, said plunger return spring, said piston actuator, said outlet ball valve and said piston return spring, a flip cap being pivotable between an open position and a closed position wherein it closes and seals said spout, said cap having coaxial pivot pins extending from either side thereof, said retention cap providing slots to removably receive said pivot pins of said flip cap, said flip cap having a bifurcated rearward end with an actuating bar extending between said bifurcations and engageable in a slot formed in said plunger to open and close said flip cap, said plunger return spring being weaker than said piston return spring so that when said plunger is depressed said flip cap will open before said piston moves, said plunger having a sliding surface which engages said actuating bar after said flip cap is fully open to maintain said cap open during movement of said piston, said means to open said outlet ball valve comprising product entering said piston bore as said piston is shifted by said plunger from said normal position into said pressure chamber toward said actuated position, said outlet ball valve being shiftable from its seat to said chamber of said piston actuator between said piston bore and said staging chamber, said chamber of said piston actuator being sized to permit product from said pressure chamber to by-pass said outlet ball valve and enter said staging chamber and said spout, said pressure chamber having an interior wall, seals on said piston cooperating with said pressure chamber wall, said seals comprising said means to close said outlet ball valve by creating a vacuum as said piston moves from said actuated to said normal position and drawing outlet ball valve back to and against said seat therefor, enlargement of said staging chamber as said piston returns to its normal position comprise said means to create said product suck-back, said product suck-back continuing as said flip cap closes and seals against said spout and said piston seal cooperating with said pressure chamber inner wall to comprise said means to draw product into said pressure chamber from said container by creating a vacuum in said pressure chamber as said piston moves further from said actuated position to said normal position.

23. The dispenser claimed in claim 22 including an adjusting nut threadedly engaged on said plunger, said adjusting nut being abuttable against said retention cap to determine said actuated posittion of said piston and the amount of product dispense for each actuation of said plunger.

24. The dispenser claimed in claim 22 wherein said inlet port has a threaded engagement with said container.

25. The dispenser claimed in claim 22 wherein said container is a collapsible container chosen from the class consisting of a collapsible tube, a container with a rolling diaphragm and a rigid container having an open top connectable to said dispenser inlet port and having an open bottom closed by a unidirectional piston, shiftable only toward said container top, said unidirectional piston comprising said means to prevent product flow from said pressure chamber to said container.

26. The dispenser claimed in claim 4 wherein said outlet valve comprises a disc-type valve having an elongated stem passing through said piston bore with clearance, that end of said piston head facing said pressure chamber having said seat for said outlet valve, a piston actuator comprising a first cylindrical portion within which said upper end of said piston stem is attached, said first cylindrical portion of said piston actuator being surmounted by a second cylindrical portion thereof having a greater diameter and separated from said first portion by a transverse web having a central flanged hole therein, said second portion of said piston actuator having an open upper end, a hollow plunger slidably received in said open upper end of said piston actuator, said outlet valve stem extending through said flanged hole with a sliding fit and into said plunger, said valve stem having an upper end attached to said plunger, said body having an open upper end, a fixed spout, and a first interior cylindrical portion comprising said pressure chamber of a diameter to slidingly receive said piston head and said first portion of said piston actuator, said body above said pressure chamber having a second interior cylindrical portion of greater diameter than said pressure chamber and terminating in said open end, a retention cap engaged on said upper end of said body and supporting an annular seal, said cap having an axial opening therein through which said upper portion of said piston actuator extends having a sliding fit with said seal, said second interior cylindrical portion of said body, together with said first portion of said piston actuator and said seal, defining an annular staging chamber leading to said spout, said first cylindrical portion of said piston actuator having a port connecting said piston bore to said staging chamber and said spout, said means for biasing said piston to said normal position comprising an outlet valve return spring located between said disc valve and an annular shoulder formed in said pressure chamber, a flip cap pivotable between an open position and a closed position wherein it closes and seals said spout, said cap having coaxial pivot pins extending from either side thereof, said retention cap providing slots to removably receive said pivot pins of said flip cap, said flip cap having a bifurcated rearward end with an actuating bar extending between said bifurcations and engageable in a slot formed in said plunger to open and close said flip cap, said retention cap, and said flip cap pivoted thereto, cooperating to retain said outlet valve return spring, said piston, said piston actuator, said plunger and said disc valve associated with said body, said plunger and said piston and piston actuator being shiftable between normal unactuated positions and actuated positions, said retention cap having a detent formed thereon to cooperate with the upper edge of said piston actuator and with a detent slot formed on said piston actuator, said detent being normally received in said detent notch whereby when said plunger is shifted toward its actuated position said piston and piston actuator will remain stationary as said flip cap and said outlet valve are opened by said plunger, said piston actuator thereafter being contactable by said plunger whereby to release said detent to shift said piston actuator and piston to their actuated positions causing product to be dispensed through said piston bore, said staging chamber and said spout, in said actuated position of said piston and piston actuator said detent overlies and holds said piston actuator whereby upon release of said plunger said outlet valve will be closed by said valve return spring resulting in said suck back and thereafter said valve return spring will overcome said detent returning said piston, piston actuator and said plunger to their normal positions causing enlargement of said staging chamber to create said product suck-back as said flip cap closes and seals against said spout, said piston being sealingly engaged with said pressure chamber wall and comprising said means to draw product into said pressure chamber from said container by creating a vacuum in said pressure chamber as said piston moves further from said actuated position to said normal position.

27. The dispenser claimed in claim 26 including a stroke adjusting knob threadedly engaged on said plunger, a pin secured to said adjusting knob, said disc valve stem having a bore therethrough, said pin extending through said disc valve stem bore and having a sliding fit with the lowermost part thereof, said means to prevent product from passing from said pressure chamber to said container comprising an inlet ball valve above and near said dispenser inlet port, said inlet ball valve comprising a stop for said pin, said pin being extendable and retractable by said adjustment knob to determine the actuated position of said piston and the amount of product dispensed for each actuation of said plunger.

28. The dispenser claimed in claim 26 wherein said inlet port has a threaded engagement with said container.

29. The dispenser claimed in claim 26 wherein said container is a collapsible container chosen from the class consisting of a collapsible tube, a container with a rolling diaphragm and a rigid container having an open top connectable to said dispenser inlet port and having an open bottom closed by a unidirectional piston, shiftable only toward said container top, said unidirectional piston comprising said means to prevent product flow from said pressure chamber to said container.

30. The dispenser claimed in claim 4 wherein said outlet valve comprises a ball valve, said piston seat for said outlet ball valve comprising a diameter change in said piston bore, said plunger being hollow with an open bottom and a closed top, a cylindrical hollow sleeve, said sleeve having an upper end extending within said plunger and attached to said plunger top, said sleeve having a lower end in which said piston stem is attached, said spout having a cylindrical portion slidably mounted about said sleeve, said piston stem bore being connected to said spout by a chamber and a cavity formed in said sleeve, said cylindrical portion of said spout having an annular flange, a return spring for said plunger being mounted between said spout annular flange and said plunger top, an annular flange near said bottom of said sleeve said plunger, said sleeve, said spout and said piston comprising a unit axially shiftable within said body between said normal position of said piston and said actuated position of said piston, said piston being biased to said normal position by a piston return spring surrounding said piston stem and located between said annular flange on said sleeve and a seat mounted on an annular interior shoulder formed in said body, said spout extending through and being shiftable in a vertical slot formed in said body, said slot having an open top and a bottom surface determining the maximum stroke of said spout and the rest of said unit, said sleeve having a lug extending into a vertical keyway in said body to maintain alignment of said sleeve cavity with said spout, said retaining means comprising a retention cap attached to said upper end of said body and retaining said plunger, said sleeve, said spout, said piston, said outlet ball valve and said compression spring within said body, said cap having a portion which normally receives, closes and seals said spout when said piston is in its normal position, said means to open said outlet valve comprising product entering said piston bore as said piston is shifted by said plunger from said normal position into said pressure chamber toward said actuated position, said outlet ball valve being shiftable from its seat to said chamber between said piston bore and said sleeve cavity, said spout is being simultaneously shiftable by said plunger from said cap to an open position against said slot bottom surface, said chamber between said piston bore and sleeve cavity being sized to permit product from said pressure chamber to by-pass said ball of said outlet ball valve, said ball of said outlet ball valve and said bore portion in said piston stem being so sized as to cooperate to comprise a product flow delay valve to assure that said spout is open before product is dispensed therefrom, said pressure chamber having an interior wall, seals on said piston cooperating with said pressure chamber wall, said seals comprising said means to close said outlet ball valve by creating a vacuum as said piston moves from said actuated position to said normal position and to draw said ball of said outlet ball valve back to and against said seat therefor, said ball of said outlet ball valve cooperating with said stem bore portion as said ball approaches its seat to comprise said means to create said product suck-back, and said piston seal cooperating with said pressure chamber inner wall to comprise said means to draw product into said pressure chamber from said container by creating a vacuum in said pressure chamber as said piston moves further from said actuated position to said normal position.

31. The dispenser claimed in claim 30 including a stroke adjusting nut threadedly engaged on said plunger, said adjusting nut being abuttable against said spout to determine said actuated position of said piston and the amount of product dispensed for each actuation of said plunger.

32. The dispenser claimed in claim 30 wherein said inlet port has a threaded engagement with said container.

33. The dispenser claimed in claim 30 wherein said container is a collapsible container chosen from the class consisting of a collapsible tube, a container with a rolling diaphragm and a rigid container having an open top connectable to said dispenser inlet port and having an open bottom closed by a unidirectional piston, shiftable only toward said container top, said unidirectional piston comprising said means to prevent product flow from said pressure chamber to said container.

34. The dispenser claimed in claim 30 wherein said container is non-collapsible, means in said dispenser for venting said container to atmosphere when product is withdrawn therefrom into said dispenser pressure chamber.

35. The dispenser claimed in claim 4 wherein said outlet valve comprises a ball valve, said piston seat for said outlet ball valve being located at a change in diameter within said piston head of said axial piston bore, said outlet ball valve having a close sliding fit in said piston bore above said seat, said piston and piston stem, together with said spout and said plunger, comprising an integral, one piece unit, said plunger portion of said unit having a bore therethrough of larger diameter than said piston bore portion above said seat, a plug in said plunger portion bore closing the top of said plunger portion and, together with said plunger portion bore, defining a chamber between said piston stem bore and said spout, said integral, one-piece unit being axially slidable within said body between said normal position of said piston and said actuated position of said piston, said piston being biased to said normal position by a piston return spring located within said pressure chamber between said piston and an annular surface formed in said pressure chamber, said spout extending through and being slidable in a vertical slot within said body, said slot having an open top and a bottom surface determining the maximum stroke of said spout and the rest of said unit, said retaining means comprising a retention cap attached to said upper end of said body and retaining said unit and said piston return spring within said body, said cap having a portion which normally receives, closes and seals said spout when said piston is in its normal position, said means to open said outlet valve comprising product entering said piston bore as said piston is shifted by said plunger from said normal position into said pressure chamber toward said actuated position, said ball of said outlet ball valve being shiftable from its seat to said chamber between said piston bore and said spout, said spout being simultaneously shiftable by said plunger from said cap to an open position against said slot bottom surface, said chamber between said piston bore and said spout being sized to permit product from said pressure chamber to by-pass said outlet ball valve, said outlet ball valve and said piston bore portion above said seat being so sized as to cooperate to comprise a product flow delay valve to assure that said spout is open before product is dispensed therefrom, said pressure chamber having an interior wall, seals on said piston cooperating with said pressure chamber interior wall, said seals comprising said means to close said outlet ball valve by creating a vacuum as said piston moves from said actuated position to said normal position and to draw said outlet ball valve back to and against said seat therefor, said outlet ball valve cooperating with said stem bore portion as said ball approaches its seat to comprise said means to create said product suck-back, and said piston seal cooperating with said pressure chamber inner wall to comprise said means to draw product into said pressure chamber from said container by creating a vacuum in said pressure chamber as said piston moves further from said actuated position to said normal position.

36. The dispenser claimed in claim 35 wherein said inlet port has a threaded engagement with said container.

37. The dispenser claimed in claim 35 wherein said container is a collapsible container chosen from the class consisting of a collapsible tube, a container with a rolling diaphragm and a rigid container having an open top connectable to said dispenser inlet port and having an open bottom closed by a unidirectional piston, shiftable only toward said container top, said unidirectional piston comprising said means to prevent product flow from said pressure chamber to said container.

38. The dispenser claimed in claim 35 wherein said container is non-collapsible, means in said dispenser for venting said container to atmosphere when product is withdrawn therefrom into said dispenser pressure chamber.

39. The dispenser claimed in claim 4 wherein said outlet valve comprises a ball valve, said piston seat for said outlet ball valve being located at the juncture of the portion of said axial bore passing through said piston head and the portion of said axial bore passing through said piston stem, said outlet ball valve having a close sliding fit in said stem bore portion, said plunger and said spout comprising an integral assembly attached to said piston stem and defining a chamber between said piston stem bore and said spout, said plunger and spout assembly comprising said plunger assembly and, together with said piston, comprising a movable unit axially shiftable within said body between said normal position of said piston and said actuated position of said piston, said piston being biased to said normal position by a piston return spring surrounding said piston stem and located between an annular flange on said plunger and spout assembly and a seat mounted on an annular interior shoulder formed in said body, said spout extending through and being shiftable in a vertical slot formed in said body, said slot having an open upper end and a bottom surface determining the maximum stroke of said unit, a cap attached to said upper end of said body and retaining said movable plunger, spout and piston unit, said outlet ball valve and said compression spring within said body, said cap having a portion which receives, closes and seals said spout when said piston is in its normal position, said means to open said outlet ball valve comprising product entering said piston bore as said piston is shifted by said plunger from said normal position into said pressure chamber toward said actuated position, said outlet ball valve being shiftable from its seat to said chamber between said piston bore and said spout while said spout is simultaneously shifted by said plunger from said cap to an open position, said chamber between said piston bore and said spout being sized to permit product from said pressure chamber to by-pass said outlet ball valve, said ball of said outlet ball valve and said bore portion in said piston stem cooperating to comprise a product flow delay valve to assure that said spout is open before product is dispensed therefrom, said pressure chamber having an interior wall, seals on said piston cooperating with said pressure chamber wall, said seals comprising said means to close said outlet ball valve by creating a vacuum as said piston moves from said actuated position to said normal position and drawing said outlet ball valve back to and against said seat therefor, of said outlet ball valve cooperating with said stem bore portion as said outlet ball valve approaches its seat to comprise said means to create said controlled product suck-back to control product drippage at the end of the dispensing cycle, and said piston seal cooperating with said pressure chamber inner wall to comprise said means to draw product into said pressure chamber from said container by creating a vacuum in said pressure chamber as said piston moves further from said actuated position to said normal position.

40. The dispenser claimed in claim 39 wherein said inlet port has a threaded engagement with said container.

41. The dispenser claimed in claim 39 wherein said container is a collapsible container chosen from the class consisting of a collapsible tube, a container with a rolling diaphragm and a rigid container having an open top connectable to said dispenser bottom port and having an open bottom closed by a unidirectional piston, shiftable only toward said container top, said unidirectional piston comprising said means to prevent product flow from said pressure chamber to said container.

42. The dispenser claimed in claim 39 wherein said container is non-collapsible, means in said dispenser for venting said container to atmosphere when product is withdrawn therefrom into said dispenser pressure chamber.

43. The dispenser claimed in claim 39 wherein said container is non-collapsible and requires venting, an annular exterior flange on said dispenser body surmounted by an annular threaded container cap for said container, said container having a threaded outlet port threadedly engageable by and sealable by said container cap, said means for preventing product from flowing from said pressure chamber to said container comprises an inlet ball valve within said dispenser body adjacent said inlet port thereof, said dispenser inlet port having a suction tube attached thereto for insertion into said container, a lip seal associated with said piston return spring seat, said dispenser body having a vent hole positioned below and adjacent said annular container cap and within said container when said container is affixed to said dispenser, said piston in its normal position having an annular sealing surface abutting said lip seal above said vent hole and an annular seal forming a seal with said dispenser body below said vent hole, said vent hole and said container being connected to atmosphere when said piston is shifted toward its actuated position and is separated from said lip seal, said vent hole remaining open to atmosphere until said piston returns to its normal position engaged with said lip seal, whereby said container is vented to atmosphere as product is drawn from said container through said inlet ball valve to said compression chamber by said piston.

44. The dispenser claimed in claim 43 wherein said lip seal is an annular seal having an inside diameter and a tapered protrusion extending therefrom, when said unit is outside said piston body and during insertion of said unit into said dispenser body, said inside diameter of said lip seal lies adjacent to and is protected by said piston stem and the outside diameter of said lip seal lies adjacent said spring seat and is protected thereby.

45. The dispenser claimed in claim 4 wherein said spout extends through and is shiftable in a vertical slot in said body, said slot having an open upper end and a bottom surface, said spout being shiftable with said plunger and said piston axially of said dispenser, said bottom surface of said slot comprising a stop determining the maximum downward movement of said spout, said plunger and said piston and thus the amount of product dispensed by each actuation of said plunger.

46. The dispenser claimed in claim 45 including exterior threads on said dispenser body and a threaded nut engaged thereon, said nut being rotatably shiftable axially of said dispenser and comprising an adjustable stop for the downward movement of said spout and a control for the amount of product dispensed per operation of said plunger.

47. The dispenser claimed in claim 45 including exterior threads on said dispenser body and a threaded nut engaged thereon, said nut being rotatably shiftable axially of said dispenser, said nut having an upper surface comprising an adjustable stop for the downward movement of said spout and a control for the amount of product dispensed per operation of said plunger, said nut having a lower flange with notches formed therein sized to receive the forward end of a toothbrush, the distance between each notch and said nut upper surface is such as to optimize the flow pattern of said product from said spout to said toothbrush when said brush is located in a notch aligned with said spout.

48. The dispenser claimed in claim 45 including exterior threads on said dispenser body and a threaded nut engaged thereon, said nut being rotatably shiftable axially of said dispenser, a sliding sleeve mounted on said body above and in abutment with said nut, said sleeve being shiftable axially of said dispenser by said nut, said sleeve being non-rotatable and having a lug engaged in said body slot for said spout, a toothbrush locator extending from said sleeve in alignment with said spout, said toothbrush locator being spaced from said spout by an optimal distance for dispensing paste on said toothbrush, said ring having an upper surface comprising an adjustable stop for said spout whereby to control the amount of product dispensed by each actuation of said plunger.

49. The dispenser claimed in claim 48 wherein said toothbrush locator is configured to releasably engage the forward end of said toothbrush and hold it in place for paste dispensing from said spout, whereby paste dispensing on said brush can be performed by a single hand of the user.

50. A collapsible container with a removable cap for use with a dispenser of the type which withdraws product from said container by vacuum, said container comprising first and second portions, said first portion constituting one of a rigid portion and a semi-rigid portion, said first portion having a smooth interior surface, said first portion having an outlet opening closable by said cap and attachable to said dispenser, said second portion being collapsible and being secured to said first portion, said first portion having an external anti-collapsing ring adjacent the juncture of said first and second portions, whereby when product is withdrawn from said container by vacuum, said first portion will not collapse under atmospheric pressure, and said second portion will act as a rolling diaphragm and collapse under the influence of atmospheric pressure into said first portion with substantially no product left therebetween.

51. The container claimed in claim 50 wherein said container portions comprise a one-piece, integral structure.

52. The container claimed in claim 50 wherein said first and second container portions are substantially hemispherical.

53. The container claimed in claim 50 including a hollow cylindrical base therefor having upper and lower ends, said upper end supporting said anti-collapsing ring and thus said container and said dispenser as well.

54. The container claimed in claim 50 including a shipping carton therefor, said anti-collapsing ring comprising a support for said container within said carton.

55. The container claimed in claim 50 wherein said container has a circular horizontal cross-section, said container further having a diameter to length ratio optimized to provide the least amount of product between said first portion and said second portion when said second portion is fully collapsed.

* * * * *